US008256521B2

(12) United States Patent
Swor et al.

(10) Patent No.: US 8,256,521 B2
(45) **Date of Patent: *Sep. 4, 2012**

(54) CONSUMABLE DOWNHOLE TOOLS

(75) Inventors: Loren Craig Swor, Duncan, OK (US); Brian Keith Wilkinson, Duncan, OK (US)

(73) Assignee: Halliburton Energy Services Inc., Duncan, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/860,471

(22) Filed: Aug. 20, 2010

(65) Prior Publication Data

US 2010/0314127 A1 Dec. 16, 2010

Related U.S. Application Data

(63) Continuation of application No. 12/650,930, filed on Dec. 31, 2009, which is a continuation of application No. 12/120,169, filed on May 13, 2008, now abandoned, which is a continuation-in-part of application No. 11/423,081, filed on Jun. 8, 2006, now abandoned, and a continuation-in-part of application No. 11/423,076, filed on Jun. 8, 2006, now abandoned.

(51) Int. Cl.
*E21B 29/02* (2006.01)

(52) U.S. Cl. ..... 166/376; 166/377

(58) Field of Classification Search ..... 166/58, 166/59, 63, 228, 243, 376, 377
See application file for complete search history.

(56) References Cited

U.S. PATENT DOCUMENTS

| | | | |
|---|---|---|---|
| 2,152,306 | A | 3/1939 | Grebe et al. |
| 2,191,783 | A | 2/1940 | Wells |
| 2,238,671 | A | 4/1941 | Woodhouse |
| 2,261,292 | A | 11/1941 | Salnikov |
| 2,436,036 | A | 2/1948 | Defenbaugh |
| 2,571,636 | A | 10/1951 | Watkins |
| 2,703,316 | A | 3/1955 | Schneider |
| 2,867,170 | A | 1/1959 | Kibby |
| 2,898,999 | A | 8/1959 | Carpenter |
| 2,935,020 | A | 5/1960 | Howard et al. |
| 3,053,182 | A | 9/1962 | Christopher |

(Continued)

FOREIGN PATENT DOCUMENTS

EP 0681087 A2 11/1995

(Continued)

OTHER PUBLICATIONS

Schwach-Abdellaoui, K., et al., "Hydrolysis and erosion studies of autocatalyzed poly(ortho esters) containing lactoyl—lactyl acid dimers," Macromolecules, 1999, pp. 301-307, vol. 32, No. 2, American Chemical Society.

(Continued)

*Primary Examiner* — Nicole Coy
(74) *Attorney, Agent, or Firm* — John W. Wustenberg; Conley Rose, P.C.

(57) ABSTRACT

A downhole tool having a body or structural component comprises a material that is at least partially consumed when exposed to heat and a source of oxygen. The material may comprise a metal, such as magnesium, which is converted to magnesium oxide when exposed to heat and a source of oxygen. The downhole tool may further comprise a torch with a fuel load that produces the heat and source of oxygen when burned. The fuel load may comprise a flammable, non-explosive solid, such as thermite.

15 Claims, 12 Drawing Sheets

U.S. PATENT DOCUMENTS

| | | | |
|---|---|---|---|
| 3,072,184 | A | 1/1963 | Parker |
| 3,087,549 | A | 4/1963 | Brunton |
| 3,099,318 | A | 7/1963 | Miller et al. |
| 3,173,484 | A | 3/1965 | Huitt et al. |
| 3,195,635 | A | 7/1965 | Fast |
| 3,205,947 | A | 9/1965 | Parker |
| 3,211,232 | A | 10/1965 | Grimmer |
| 3,302,719 | A | 2/1967 | Fischer |
| 3,364,995 | A | 1/1968 | Atkins et al. |
| 3,366,178 | A | 1/1968 | Malone et al. |
| 3,382,927 | A | 5/1968 | Davis, Jr. |
| 3,414,055 | A | 12/1968 | Vogt, Jr. |
| 3,455,390 | A | 7/1969 | Gallus |
| 3,768,563 | A | 10/1973 | Blount |
| 3,784,585 | A | 1/1974 | Schmitt et al. |
| 3,828,854 | A | 8/1974 | Templeton et al. |
| 3,868,998 | A | 3/1975 | Lybarger et al. |
| 3,912,692 | A | 10/1975 | Casey et al. |
| 3,954,438 | A | 5/1976 | Hunter et al. |
| 3,954,788 | A | 5/1976 | Hunter et al. |
| 3,960,736 | A | 6/1976 | Free et al. |
| 3,968,840 | A | 7/1976 | Tate |
| 3,997,277 | A | 12/1976 | Swisher, Jr. et al. |
| 3,998,744 | A | 12/1976 | Arnold et al. |
| 4,023,494 | A | 5/1977 | Barton et al. |
| 4,068,718 | A | 1/1978 | Cooke, Jr. et al. |
| 4,089,035 | A | 5/1978 | Smith |
| 4,099,464 | A | 7/1978 | Cross et al. |
| 4,167,521 | A | 9/1979 | Fowler et al. |
| 4,169,798 | A | 10/1979 | DeMartino |
| 4,178,852 | A | 12/1979 | Smith et al. |
| 4,184,430 | A | 1/1980 | Mock |
| 4,184,838 | A | 1/1980 | Burns et al. |
| 4,187,909 | A | 2/1980 | Erbstoesser |
| 4,237,972 | A | 12/1980 | Lanmon, II |
| 4,248,299 | A | 2/1981 | Roeder |
| 4,262,702 | A | 4/1981 | Streich |
| 4,275,786 | A | 6/1981 | Lee |
| 4,282,034 | A | 8/1981 | Smith et al. |
| 4,286,629 | A | 9/1981 | Streich et al. |
| 4,290,486 | A | 9/1981 | Regalbuto |
| 4,295,424 | A | 10/1981 | Smith et al. |
| 4,298,063 | A | 11/1981 | Regalbuto et al. |
| 4,334,579 | A | 6/1982 | Gregg |
| 4,351,082 | A | 9/1982 | Ackerman et al. |
| 4,378,844 | A | 4/1983 | Parrish et al. |
| 4,387,769 | A | 6/1983 | Erbstoesser et al. |
| 4,417,989 | A | 11/1983 | Hunter |
| 4,424,263 | A | 1/1984 | Howell et al. |
| 4,430,662 | A | 2/1984 | Jillie, Jr. et al. |
| 4,432,419 | A | 2/1984 | Streich |
| 4,442,975 | A | 4/1984 | Long et al. |
| 4,470,915 | A | 9/1984 | Conway |
| 4,498,228 | A | 2/1985 | Jillie, Jr. et al. |
| 4,501,757 | A | 2/1985 | Smith et al. |
| 4,507,082 | A | 3/1985 | Wardlaw, III |
| 4,526,695 | A | 7/1985 | Erbstoesser et al. |
| 4,527,605 | A | 7/1985 | Ede et al. |
| 4,536,414 | A | 8/1985 | Kroger et al. |
| 4,554,567 | A | 11/1985 | Jillie et al. |
| 4,559,708 | A | 12/1985 | Duel et al. |
| 4,593,350 | A | 6/1986 | Mitchell et al. |
| 4,598,769 | A | 7/1986 | Robertson |
| 4,621,562 | A | 11/1986 | Carr et al. |
| 4,633,711 | A | 1/1987 | Hipple et al. |
| 4,655,632 | A | 4/1987 | Smith |
| 4,678,037 | A | 7/1987 | Smith |
| 4,688,641 | A | 8/1987 | Knieriemen |
| 4,700,778 | A | 10/1987 | Smith et al. |
| 4,713,859 | A | 12/1987 | Smith, Jr. |
| 4,715,967 | A | 12/1987 | Bellis et al. |
| 4,716,964 | A | 1/1988 | Erbstoesser et al. |
| 4,743,257 | A | 5/1988 | Törmälä et al. |
| 4,744,630 | A | 5/1988 | Hipple et al. |
| 4,754,417 | A | 6/1988 | Beeson et al. |
| 4,790,385 | A | 12/1988 | McClure et al. |
| 4,803,959 | A | 2/1989 | Sherrick et al. |
| 4,809,783 | A | 3/1989 | Hollenbeck et al. |
| 4,815,160 | A | 3/1989 | Smith, Jr. |
| 4,815,351 | A | 3/1989 | Smith et al. |
| 4,834,184 | A | 5/1989 | Streich et al. |
| 4,843,118 | A | 6/1989 | Lai et al. |
| 4,848,467 | A | 7/1989 | Cantu et al. |
| 4,889,638 | A | 12/1989 | Rockford et al. |
| 4,908,904 | A | 3/1990 | Smith, Jr. |
| 4,957,165 | A | 9/1990 | Cantu et al. |
| 4,961,466 | A | 10/1990 | Himes et al. |
| 4,986,353 | A | 1/1991 | Clark et al. |
| 4,986,354 | A | 1/1991 | Cantu et al. |
| 4,986,355 | A | 1/1991 | Casad et al. |
| 4,995,758 | A | 2/1991 | Smith |
| 5,012,180 | A | 4/1991 | Dalrymple et al. |
| 5,025,412 | A | 6/1991 | Dalrymple et al. |
| 5,032,982 | A | 7/1991 | Dalrymple et al. |
| 5,070,823 | A | 12/1991 | Ackerman et al. |
| 5,082,056 | A | 1/1992 | Tackett, Jr. |
| 5,090,087 | A | 2/1992 | Hipple et al. |
| 5,113,935 | A | 5/1992 | Jones et al. |
| D327,105 | S | 6/1992 | Smith, Jr. |
| 5,117,911 | A | 6/1992 | Navarette et al. |
| 5,129,322 | A | 7/1992 | Christopher et al. |
| 5,131,472 | A | 7/1992 | Dees et al. |
| 5,153,509 | A | 10/1992 | Dalrymple et al. |
| 5,188,183 | A | 2/1993 | Hopmann et al. |
| 5,193,199 | A | 3/1993 | Dalrymple et al. |
| 5,216,050 | A | 6/1993 | Sinclair |
| 5,220,673 | A | 6/1993 | Dalrymple et al. |
| 5,222,218 | A | 6/1993 | Smith |
| 5,224,540 | A | 7/1993 | Streich et al. |
| 5,248,217 | A | 9/1993 | Smith |
| D340,412 | S | 10/1993 | Smith |
| 5,253,712 | A | 10/1993 | Swor |
| 5,261,488 | A | 11/1993 | Gullet et al. |
| 5,267,533 | A | 12/1993 | Smith |
| 5,271,468 | A | 12/1993 | Streich et al. |
| 5,271,675 | A | 12/1993 | Fagan et al. |
| 5,272,333 | A | 12/1993 | Fagan et al. |
| 5,294,469 | A | 3/1994 | Suzuki et al. |
| 5,309,299 | A | 5/1994 | Crossland et al. |
| 5,318,377 | A | 6/1994 | Swisher, Jr. et al. |
| 5,326,969 | A | 7/1994 | Fagan et al. |
| 5,330,005 | A | 7/1994 | Card et al. |
| 5,333,684 | A | 8/1994 | Walter et al. |
| 5,343,954 | A | 9/1994 | Bohlen et al. |
| 5,390,737 | A | 2/1995 | Jacobi et al. |
| 5,390,966 | A | 2/1995 | Cox et al. |
| 5,404,956 | A | 4/1995 | Bohlen et al. |
| 5,405,212 | A | 4/1995 | Swisher, Jr. et al. |
| 5,435,394 | A | 7/1995 | Robertson |
| 5,439,055 | A | 8/1995 | Card et al. |
| 5,439,059 | A | 8/1995 | Harris et al. |
| 5,440,917 | A | 8/1995 | Smith et al. |
| 5,460,226 | A | 10/1995 | Lawson et al. |
| 5,467,824 | A | 11/1995 | DeMarsh et al. |
| 5,479,986 | A | 1/1996 | Gano et al. |
| 5,488,224 | A | 1/1996 | Fagan et al. |
| 5,492,178 | A | 2/1996 | Nguyen et al. |
| 5,501,274 | A | 3/1996 | Nguyen et al. |
| 5,501,275 | A | 3/1996 | Card et al. |
| 5,505,261 | A | 4/1996 | Huber et al. |
| 5,513,570 | A | 5/1996 | Mulcahy |
| 5,540,279 | A | 7/1996 | Branch et al. |
| 5,540,293 | A | 7/1996 | Mohaupt |
| 5,551,514 | A | 9/1996 | Nelson et al. |
| 5,558,153 | A | 9/1996 | Holcombe et al. |
| 5,569,286 | A | 10/1996 | Peckham et al. |
| 5,588,907 | A | 12/1996 | DePietro et al. |
| 5,591,700 | A | 1/1997 | Harris et al. |
| 5,607,017 | A | 3/1997 | Owens et al. |
| 5,607,905 | A | 3/1997 | Dobson, Jr. et al. |
| D381,024 | S | 7/1997 | Hinzmann et al. |
| 5,685,372 | A | 11/1997 | Gano |
| 5,689,085 | A | 11/1997 | Turner |
| D387,865 | S | 12/1997 | Peckham et al. |
| 5,698,322 | A | 12/1997 | Tsai et al. |
| 5,701,959 | A | 12/1997 | Hushbeck et al. |
| 5,709,269 | A | 1/1998 | Head |

5,713,621 A 2/1998 Krenkel et al.
5,720,824 A 2/1998 Bronson et al.
5,740,234 A 4/1998 Black et al.
5,760,250 A 6/1998 Jones et al.
5,763,021 A 6/1998 Young et al.
5,765,641 A 6/1998 Shy et al.
5,775,425 A 7/1998 Weaver et al.
5,783,527 A 7/1998 Dobson, Jr. et al.
5,791,821 A 8/1998 Kiesler
5,829,200 A 11/1998 Jones et al.
5,839,515 A 11/1998 Yuan et al.
5,847,138 A 12/1998 Jones et al.
5,849,401 A 12/1998 El-Afandi et al.
D412,062 S 7/1999 Potter et al.
5,931,229 A 8/1999 Lehr et al.
5,934,376 A 8/1999 Nguyen et al.
5,984,007 A 11/1999 Yuan et al.
5,984,573 A 11/1999 Smith
5,990,051 A 11/1999 Ischy et al.
6,016,753 A 1/2000 Glenn et al.
6,021,457 A 2/2000 Archer et al.
6,026,903 A 2/2000 Shy et al.
6,045,420 A 4/2000 Small et al.
6,053,247 A 4/2000 Wesson et al.
6,061,507 A 5/2000 Fitzgerald et al.
6,065,540 A 5/2000 Thomeer et al.
6,092,601 A 7/2000 Gano et al.
6,095,247 A 8/2000 Streich et al.
6,102,117 A 8/2000 Swor et al.
6,110,875 A 8/2000 Tjon-Joe-Pin et al.
6,131,661 A 10/2000 Conner et al.
6,135,987 A 10/2000 Tsai et al.
6,143,698 A 11/2000 Murphey et al.
6,161,622 A 12/2000 Robb et al.
6,162,766 A 12/2000 Muir et al.
6,167,127 A 12/2000 Smith et al.
6,175,490 B1 1/2001 Papa et al.
6,186,226 B1 2/2001 Robertson
6,189,615 B1 2/2001 Sydansk
6,191,032 B1 2/2001 Tiffin et al.
6,195,717 B1 2/2001 Henderson et al.
6,209,646 B1 4/2001 Reddy et al.
6,218,343 B1 4/2001 Burts, Jr.
6,220,345 B1 4/2001 Jones et al.
6,220,349 B1 4/2001 Vargus et al.
6,220,350 B1 4/2001 Brothers et al.
6,237,688 B1 5/2001 Burleson et al.
6,242,390 B1 6/2001 Mitchell et al.
6,249,834 B1 6/2001 Henderson et al.
6,253,334 B1 6/2001 Amdahl et al.
6,263,972 B1 7/2001 Richard et al.
6,287,672 B1 9/2001 Fields et al.
6,318,460 B1 11/2001 Swor et al.
6,323,307 B1 11/2001 Bigg et al.
6,324,608 B1 11/2001 Papa et al.
6,328,105 B1 12/2001 Betzold
6,328,110 B1 12/2001 Joubert
6,334,488 B1 1/2002 Freiheit
6,354,372 B1 3/2002 Carisella et al.
6,357,396 B1 3/2002 Stansfield et al.
6,375,275 B1 4/2002 Smith, Jr. et al.
6,376,524 B1 4/2002 Barr et al.
6,378,606 B1 4/2002 Swor et al.
6,387,986 B1 5/2002 Moradi-Araghi et al.
6,394,180 B1 5/2002 Berscheidt et al.
6,394,185 B1 5/2002 Constien
6,397,950 B1 6/2002 Streich et al.
6,409,219 B1 6/2002 Broome et al.
6,415,712 B1 7/2002 Helland et al.
6,422,314 B1 7/2002 Todd et al.
6,427,775 B1 8/2002 Dusterhoft et al.
6,443,538 B1 9/2002 Smith, Jr. et al.
6,444,316 B1 9/2002 Reddy et al.
6,460,378 B1 10/2002 Dong et al.
6,461,218 B1 10/2002 Mullaney et al.
6,470,835 B1 10/2002 Stansfield et al.
6,481,497 B2 11/2002 Swor et al.
6,491,116 B2 12/2002 Berscheidt et al.
6,494,263 B2 12/2002 Todd
6,520,254 B2 2/2003 Hurst et al.
6,527,051 B1 3/2003 Reddy et al.
6,536,349 B2 3/2003 Patterson et al.
6,536,525 B1 3/2003 Haugen et al.
D473,517 S 4/2003 Overthun et al.
6,554,071 B1 4/2003 Reddy et al.
6,561,270 B1 5/2003 Budde
6,565,955 B2 5/2003 Fields et al.
6,584,336 B1 6/2003 Ali et al.
6,598,679 B2 7/2003 Robertson
6,599,863 B1 7/2003 Palmer et al.
D481,226 S 10/2003 Overthun et al.
6,633,933 B1 10/2003 Smith et al.
6,640,700 B2 11/2003 Helland et al.
6,655,459 B2 12/2003 Mackay
6,666,266 B2 12/2003 Starr et al.
6,666,275 B2 12/2003 Neal et al.
6,667,279 B1 12/2003 Hessert et al.
6,669,771 B2 12/2003 Tokiwa et al.
D485,096 S 1/2004 Overthun et al.
6,681,856 B1 1/2004 Chatterji et al.
6,687,261 B1 2/2004 Skeba et al.
6,695,050 B2 2/2004 Winslow et al.
6,695,051 B2 2/2004 Smith et al.
6,695,056 B2 2/2004 Haugen et al.
6,702,019 B2 3/2004 Dusterhoft et al.
6,704,408 B2 3/2004 Smith et al.
6,704,991 B1 3/2004 Coulborn et al.
6,710,019 B1 3/2004 Sawdon et al.
6,712,143 B2 3/2004 Robertson
6,742,069 B2 5/2004 Papa et al.
6,761,174 B2 7/2004 Jupe et al.
6,761,218 B2 7/2004 Nguyen et al.
6,770,028 B1 8/2004 Ali et al.
6,772,775 B2 8/2004 Ackerman et al.
6,776,238 B2 8/2004 Dusterhoft et al.
6,782,679 B2 8/2004 Helland et al.
6,792,866 B2 9/2004 Grattan
6,793,018 B2 9/2004 Dawson et al.
6,808,024 B2 10/2004 Schwendemann et al.
6,837,309 B2 1/2005 Boney et al.
6,840,318 B2 1/2005 Lee et al.
6,854,521 B2 2/2005 Echols et al.
6,856,737 B1 2/2005 Parker et al.
6,861,394 B2 3/2005 Ballard et al.
6,862,502 B2 3/2005 Peltz et al.
6,886,635 B2 5/2005 Hossaini et al.
6,895,636 B2 5/2005 Nussbaum
6,896,061 B2 5/2005 Hriscu et al.
6,898,097 B2 5/2005 Dugger et al.
6,925,937 B2 8/2005 Robertson
6,926,086 B2 8/2005 Patterson et al.
6,949,491 B2 9/2005 Cooke, Jr.
6,954,252 B1 10/2005 Crossland et al.
6,959,765 B2 11/2005 Bell
6,966,386 B2 11/2005 Ringgenberg et al.
6,971,449 B1 12/2005 Robertson
6,975,786 B1 12/2005 Warr et al.
6,976,534 B2 12/2005 Sutton et al.
6,997,252 B2 2/2006 Porter et al.
7,013,599 B2 3/2006 Smith et al.
7,027,146 B1 4/2006 Smith et al.
D520,355 S 5/2006 Overthun et al.
7,036,587 B2 5/2006 Munoz, Jr. et al.
7,044,230 B2 5/2006 Starr et al.
7,048,066 B2 5/2006 Ringgenberg et al.
7,049,272 B2 5/2006 Sinclair et al.
7,055,094 B2 5/2006 Imielinski et al.
7,066,258 B2 6/2006 Justus et al.
7,080,688 B2 7/2006 Todd et al.
7,093,664 B2 8/2006 Todd et al.
7,104,326 B2 9/2006 Grattan et al.
7,117,956 B2 10/2006 Grattan et al.
7,131,491 B2 11/2006 Blauch et al.
7,166,560 B2 1/2007 Still et al.
7,168,494 B2 1/2007 Starr et al.
7,178,596 B2 2/2007 Blauch et al.
7,195,068 B2 3/2007 Todd
7,210,533 B2 5/2007 Starr et al.

| | | | |
|---|---|---|---|
| 7,287,592 | B2 | 10/2007 | Surjaatmadja et al. |
| 7,322,416 | B2 | 1/2008 | Burris, II et al. |
| 7,328,750 | B2 | 2/2008 | Swor et al. |
| 7,353,879 | B2 | 4/2008 | Todd et al. |
| 7,363,860 | B2 | 4/2008 | Wilson et al. |
| 7,363,967 | B2 | 4/2008 | Burris, II et al. |
| 7,393,423 | B2 | 7/2008 | Liu |
| 7,431,075 | B2 | 10/2008 | Brooks et al. |
| 7,497,278 | B2 | 3/2009 | Schriener et al. |
| 7,553,800 | B2 | 6/2009 | Munoz, Jr. |
| 7,591,318 | B2 | 9/2009 | Tilghman |
| 7,798,236 | B2 | 9/2010 | McKeachnie et al. |
| 2001/0016562 | A1 | 8/2001 | Muir et al. |
| 2003/0047312 | A1 | 3/2003 | Bell |
| 2003/0130133 | A1 | 7/2003 | Vollmer |
| 2003/0168214 | A1 | 9/2003 | Sollesnes |
| 2004/0231845 | A1 | 11/2004 | Cooke, Jr. |
| 2005/0056425 | A1 | 3/2005 | Grigsby et al. |
| 2005/0241835 | A1 | 11/2005 | Burris, II et al. |
| 2005/0269083 | A1 | 12/2005 | Burris, II et al. |
| 2007/0284097 | A1 | 12/2007 | Swor et al. |
| 2007/0284114 | A1 | 12/2007 | Swor et al. |
| 2008/0202764 | A1 | 8/2008 | Clayton et al. |
| 2008/0257549 | A1 | 10/2008 | Swor et al. |
| 2009/0308620 | A1 | 12/2009 | Tilghman |
| 2010/0089566 | A1 | 4/2010 | Swor et al. |
| 2010/0101803 | A1 | 4/2010 | Clayton et al. |
| 2010/0108327 | A1 | 5/2010 | Swor et al. |
| 2010/0108328 | A1 | 5/2010 | Swor et al. |
| 2011/0303407 | A1 | 12/2011 | Swor et al. |
| 2012/0031626 | A1 | 2/2012 | Clayton et al. |
| 2012/0048572 | A1 | 3/2012 | Swor et al. |
| 2012/0055666 | A1 | 3/2012 | Swor et al. |

FOREIGN PATENT DOCUMENTS

| | | | |
|---|---|---|---|
| EP | 1132571 | A1 | 9/2001 |
| GB | 2410964 | A | 8/2005 |
| WO | 0057022 | A1 | 9/2000 |
| WO | 0102698 | A1 | 1/2001 |
| WO | 0177484 | A1 | 10/2001 |
| WO | 2004007905 | A1 | 1/2004 |
| WO | 2004037946 | A1 | 5/2004 |
| WO | 2004038176 | A1 | 5/2004 |

OTHER PUBLICATIONS

Simmons, Tara L., et al., "Poly(phenyllactide): synthesis, characterization, and hydrolytic degradation," Biomacromolecules, 2001, pp. 658-663 vol. 2, No. 3, American Chemical Society.

Skrabal, Anton, et al., "The hydrolysis rate of orthoformic acid ethyl ether," Chemical Institute of the University of Graz, Jan. 13, 1921, pp. 1-38 plus cover page.

Todd, B., et al., "A chemical 'trigger' useful for oilfield applications," Paper No. 92709, Nov. 18, 2005, 2 pages, http://www.spe.org/elibinfo/eLibrary_Papers/spe/2005/05OCS/00092709/00092709.htm, Society of Petroleum Engineers.

Todd, Brad, et al., "Laboratory device for testing of delayed-breaker solutions on horizontal wellbore filter cakes," SPE 68968, 2001, pp. 1-9, Society of Petroleum Engineers, Inc.

Toncheva, V., et al., "Use of block copolymers of poly(ortho esters) and poly(ethylene glycol) micellar carriers as potential tumour targeting systems," Journal of Drug Targeting, 2003, pp. 345-353, vol. 11, No. 6, Taylor & Francis Ltd.

Yin, Mao, et al., "Preparation and characterization of substituted polylactides," Macromolecules, Nov. 16, 1999, pp. 7711-7718. vol. 32, No. 23, American Chemical Society.

Yin, Mao, et al., "Synthesis and properties of polymers derived from substituted lactic acids," 2001, pp. 147-159, American Chemical Society.

Zignani, M., et al., "Subconjunctival biocompatibility of a viscous bioerodable poly(ortho ester)," 1998, pp. 277-285, John Wiley & Sons, Inc.

Office Action dated Aug. 12, 2010 (58 pages), U.S. Appl. No. 12/639,567, filed Dec. 16, 2009.

Ahmad, M., et al., "Ortho Ester Hydrolysis: Direct Evidence for a Three-Stage Reaction Mechanism," XP-002322843, May 9, 1979, 1 page.

Becker, Thomas E., et al., Drill-in fluid filter-cake behavior during the gravel-packing of horizontal intervals—a laboratory simulation, SPE 50715, 1999, pp. 1-7, Society of Petroleum Engineers, Inc.

Brady, M. E., et al., "Filtercake cleanup in open-hole gravel-packed completions: a necessity or a myth?" SPE 63232, 2000, pp. 1-12, Society of Petroleum Engineers Inc.

Cantu, Lisa A., et al., "Laboratory and field evaluation of a combined fluid-loss-control additive and gel breaker for fracturing fluids," SPE Production Engineering, Aug. 1990, pp. 253-260, Society of Petroleum Engineers.

Chiang, Y., et al., "Hydrolysis of ortho esters: further investigation of the factors which control the rate-determining step," XP-002322842, Nov. 16, 1983, 1 page.

Dechy-Cabaret, Odile, et al., "Controlled ring-opening polymerization of lactide and glycolide," American Chemical Society, Apr. 26, 2004, 30 pages.

Demo Lab: The Thermite Reaction, "The general chemistry demo lab," http://www.ilpi.com/genchem/demo/thermite/index.html, Jun. 7, 2006, pp. 1-5.

Dickinson, W., et al., "A second-generation horizontal drilling system," IADC/SPE 14804, 1986, pp. 673-678 plus 4 pages of drawings, IADC/SPE 1986 Drilling Conference.

Dickinson, W. et al., "Gravel packing of horizontal wells," SPE 16931, 1987, pp. 519-528, Society of Petroleum Engineers.

Economides, Michael J., "Petroleum well construction," 1998, pp. 8-10, 405-409, 533-534, 537-542, 1 cover page, and 1 publishing page, John Wiley & Sons Ltd, England.

Fibox Enclosing Innovations, "Chemical resistance—polycarbonate," www.fiboxusa.com, Jul. 25, 2007, pp. 1-5, Fibox Enclosures.

Foreign communication from a related counterpart application—International Search Report, PCT/GB2005/000166, Mar. 17, 2005, 2 pages.

Foreign communication from a related counterpart application—International Search Report, PCT/GB2004/005309, Apr. 13, 2005, 4 pages.

Foreign communicaiton from a related counterpart application—International Search Report and Written Opinion, PCT/GB2005/000995, Jun. 7, 2005, 13 pages.

Foreign comunication from a related counterpart application—International Preliminary Report on Patentability, PCT/GB2004/005309, Jul. 10, 2006, 7 pages.

Foreign communication from a related counterpart application—International Search Report and Written Opinion, PCT/GB2007/002111, Sep. 3, 2007, 11 pages.

Foreign communication from a related counterpart application—Invitation to Pay Additional Fees, PCT/GB2007/002754, Oct. 2, 2007, 5 pages.

Foreign communication from a related counterpart application—International Search Report and Written Opinion, PCT/GB2007/002754, Dec. 10, 2007, 16 pages.

Foreign communication from a related counterpart application—Invitation to Pay Additional Fees, PCT/GB2008/000561, Jun. 3, 2008, 4 pages.

Foreign communication from a related counterpart application—EPO Examination Report for European Application No. 07 766 317. 7, Oct. 1, 2009, 2 pages.

Foreign communication from a related counterpart application—EPO Examination Report for European Application No. 07 766 317. 7, Mar. 10, 2010, 4 pages.

Halliburton brochure entitled "Sand control applications," undated but admitted to be prior art, pp. 2-1 to 2-6, Halliburton.

Heller, J., et al., "Poly(ortho esters)—their development and some recent applications," European Journal of Pharmaceutics and Biopharmaceutics, 2000, pp. 121-128, vol. 50, Elsevier Science B.V.

Heller, J., et al., "Release of norethindrone from poly(ortho esters)," Mid-Aug. 1981, pp. 727-731, vol. 21, No. 11, Polymer Engineering and Science.

Heller, Jorge, et al., "Poly(ortho esters) for the pulsed and continuous delivery of peptides and proteins," Controlled Release and Biomedical Polymers Department, SRI International, undated but admitted to be prior art, pp. 39-56.

Heller, Jorge, et al., "Poly(ortho esters)—from concept to reality," Biomacromolecules, Sep./Oct. 2004, pp. 1625-1632, vol. 5, No. 5, American Chemical Society.
Heller, Jorge, et al., "Poly(ortho esters): synthesis, characterization, properties and uses," Advanced Drug Delivery Reviews, 2002, pp. 1015-1039, vol. 54, Elsevier Science B.V.
Lafontaine, Jackie, et al., "New concentric annular packing system limits bridging in horizontal gravel packs," SPE 56778, 1999, pp. 1-11, Society of Petroleum Engineers, Inc.
Ng, S.Y., et al., "Development of a poly(ortho ester) prototype with a latent acid in the polymer backbone for 5-flourouracil delivery," Journal of Controlled Release, 2000, pp. 367-374, vol. 65, Elsevier Science B.V.
Ng, S.Y., et al., "Synthesis and erosion studies of self-catalyzed poly(ortho ester)s," Macromolecules, 1997, pp. 770-772, vol. 30, No. 4, American Chemical Society.
Office Action dated Jan. 31, 2008 (7 pages), U.S. Appl. No. 11/423,076, filed Jun. 8, 2006.
Office Action dated Jan. 31, 2008 (12 pages), U.S. Appl. No. 11/423,081, filed Jun. 8, 2006.
Office Action (Final) dated Aug. 12, 2008 (11 pages), U.S. Appl. No. 11/423,081, filed Jun. 8, 2006.
Office Action (Final) dated Aug. 12, 2008 (12 pages), U.S. Appl. No. 11/423,076, filed Jun. 8, 2006.
Office Action dated Dec. 15, 2008 (44 pages), U.S. Appl. No. 11/677,755, filed Feb. 22, 2007.
Office Action dated Mar. 16, 2009 (21 pages), U.S. Appl. No. 11/423,076, filed Jun. 8, 2006.
Office Action dated Mar. 17, 2009 (24 pages), U.S. Appl. No. 11/423,081, filed Jun. 8, 2006.
Office Action dated Mar. 18, 2009 (9 pages), U.S. Appl. No. 12/120,169, filed May 13, 2008.
Office Action dated Jul. 27, 2009 (11 pages), U.S. Appl. No. 11/423,076, filed Jun. 8, 2006.
Office Action (Final) dated Aug. 6, 2009 (13 pages), U.S. Appl. No. 11/677,755, filed Feb. 22, 2007.
Office Action (Final) dated Aug. 12, 2009 (57 pages) U.S. Appl. No. 12/120,169, filed May 13, 2008.
Office Action (Final) dated Aug. 14, 2009 (14 pages), U.S. Appl. No. 11/423,081, filed Jun. 8, 2006.
Office Action dated May 10, 2010 (65 pages), U.S. Appl. No. 12/548,169, filed Aug. 26, 2009.
Office Action dated May 11, 2010 (9 pages), U.S. Appl. No. 12/649,802, filed Dec. 30, 2009.
PoroFlex™ Expandable Screen Completion Systems, Discussion and Development Status, undated but admitted to be prior art, 40 pages.
Rothen-Weinhold, A., et al., "Release of BSA from poly(ortho ester) extruded thin strands," Journal of Controlled Release, 2001, pp. 31-37, vol. 71, Elsevier Science B.V.
Rozner, A. G., et al., "Pyronol torch—a non-explosive underwater cutting tool," Offshore Technology Conference, Paper No. OTC 2705, 1976, pp. 1015-1020 plus 2 pages of figures, American Institute of Mining, Metallurgical, and Petroleum Engineers, Inc.
Schlumberger brochure entitled "STIMPAC service brochure," 2000, 8 pages, Schlumberger Limited.
Schwach-Abdellaoui, K., et al., "Control of molecular weight for auto-catalyzed poly(ortho ester) obtained by polycondensation reaction," International Journal of Polymer Anal. Charact., 2002, pp. 145-161, vol. 7, Taylor & Francis.
Office Action dated Nov. 29, 2010 (56 pages), U.S. Appl. No. 12/649,802, filed Dec. 30, 2009.
Office Action dated Dec. 27, 2010 (64 pages), U.S. Appl. No. 12/650,930, filed Dec. 31, 2009.
Office Action dated Dec. 29, 2010 (64 pages), U.S. Appl. No. 12/650,939, filed Dec. 31, 2009.
Office Action (Final) dated Feb. 25, 2011 (13 pages), U.S. Appl. No. 12/639,567, filed Dec. 16, 2009.
Advisory Action dated Sep. 12, 2011 (3 pages), U.S. Appl. No. 12/650,939, filed Dec. 31, 2009.
Office Action (Final) dated Nov. 17, 2010 (12 pages), U.S. Appl. No. 12/548,169, filed Aug. 26, 2009.
Office Action (Final) dated May 12, 2011 (14 pages), U.S. Appl. No. 12/650,930, filed Dec. 31, 2009.
Office Action (Final) dated May 12, 2011 (13 pages), U.S. Appl. No. 12/650,939, filed Dec. 31, 2009.
Office Action dated Oct. 25, 2011 (27 pages), U.S. Appl. No. 13/218,198, filed Aug. 25, 2011.
Office Action dated Dec. 7, 2011 (78 pages), U.S. Appl. No. 13/277,016, filed Oct. 19, 2011.
Office Action dated Dec. 19, 2011 (74 pages), U.S. Appl. No. 13/293,557, filed Nov. 10, 2011.
Office Action dated Feb. 2, 2012 (83 pages), U.S. Appl. No. 13/293,502, filed Nov. 10, 2011.
Office Action dated May 16, 2012 (18 pages), U.S. Appl. No. 13/277,016, filed Oct. 19, 2011.

CONSUMABLE DOWNHOLE TOOLS

CROSS-REFERENCE TO RELATED APPLICATIONS

This is a Continuation Application of U.S. patent application Ser. No. 12/650,930 filed Dec. 31, 2009 and published as US 2010/0108327 A1, which is a continuation application of U.S. patent application Ser. No. 12/120,169 filed May 13, 2008 and published as US 2008/0257549 A1, which is a continuation-in-part of U.S. patent application Ser. No. 11/423,081 filed Jun. 8, 2006 and published as US 2007/0284114 A1 and a continuation-in-part of U.S. of patent application Ser. No. 11/423,076 filed Jun. 8, 2006 and published as US 2007/0284097 A1, each of which is incorporated herein in its entirety.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates to consumable downhole tools and methods of removing such tools from well bores. More particularly, the present invention relates to downhole tools comprising materials that are burned and/or consumed when exposed to heat and an oxygen source and methods and systems for consuming such downhole tools in situ.

BACKGROUND

A wide variety of downhole tools may be used within a well bore in connection with producing hydrocarbons or reworking a well that extends into a hydrocarbon formation. Downhole tools such as frac plugs, bridge plugs, and packers, for example, may be used to seal a component against casing along the well bore wall or to isolate one pressure zone of the formation from another. Such downhole tools are well known in the art.

After the production or reworking operation is complete, these downhole tools must be removed from the well bore. Tool removal has conventionally been accomplished by complex retrieval operations, or by milling or drilling the tool out of the well bore mechanically. Thus, downhole tools are either retrievable or disposable. Disposable downhole tools have traditionally been formed of drillable metal materials such as cast iron, brass and aluminum. To reduce the milling or drilling time, the next generation of downhole tools comprises composites and other non-metallic materials, such as engineering grade plastics. Nevertheless, milling and drilling continues to be a time consuming and expensive operation. To eliminate the need for milling and drilling, other methods of removing disposable downhole tools have been developed, such as using explosives downhole to fragment the tool, and allowing the debris to fall down into the bottom of the well bore. This method, however, sometimes yields inconsistent results. Therefore, a need exists for disposable downhole tools that are reliably removable without being milled or drilled out, and for methods of removing such disposable downhole tools without tripping a significant quantity of equipment into the well bore.

SUMMARY OF THE INVENTION

Disclosed herein is a downhole tool having a body or structural component comprising a material that is at least partially consumed when exposed to heat and a source of oxygen. In an embodiment, the material comprises a metal, and the metal may comprise magnesium, such that the magnesium metal is converted to magnesium oxide when exposed to heat and a source of oxygen. The downhole tool may further comprise an enclosure for storing an accelerant. In various embodiments, the downhole tool is a frac plug, a bridge plug, or a packer.

The downhole tool may further comprise a torch with a fuel load that produces the heat and source of oxygen when burned. In various embodiments, the fuel load comprises a flammable, non-explosive solid, or the fuel load comprises thermite. The torch may further comprise a torch body with a plurality of nozzles distributed along its length, and the nozzles may distribute molten plasma produced when the fuel load is burned. In an embodiment, the torch further comprises a firing mechanism with heat source to ignite the fuel load, and the firing mechanism may further comprise a device to activate the heat source. In an embodiment, the firing mechanism is an electronic igniter. The device that activates the heat source may comprise an electronic timer, a mechanical timer, a spring-wound timer, a volume timer, or a measured flow timer, and the timer may be programmable to activate the heat source when pre-defined conditions are met. The pre-defined conditions comprise elapsed time, temperature, pressure, volume, or any combination thereof. In another embodiment, the device that activates the heat source comprises a pressure-actuated firing head.

NOTATION AND NOMENCLATURE

Certain terms are used throughout the following description and claims to refer to particular assembly components. This document does not intend to distinguish between components that differ in name but not function. In the following discussion and in the claims, the terms "including" and "comprising" are used in an open-ended fashion, and thus should be interpreted to mean "including, but not limited to . . . ".

Reference to up or down will be made for purposes of description with "up", "upper", "upwardly" or "upstream" meaning toward the surface of the well and with "down", "lower", "downwardly" or "downstream" meaning toward the lower end of the well, regardless of the well bore orientation. Reference to a body or a structural component refers to components that provide rigidity, load bearing ability and/or structural integrity to a device or tool.

DETAILED DESCRIPTION

Figure 1:
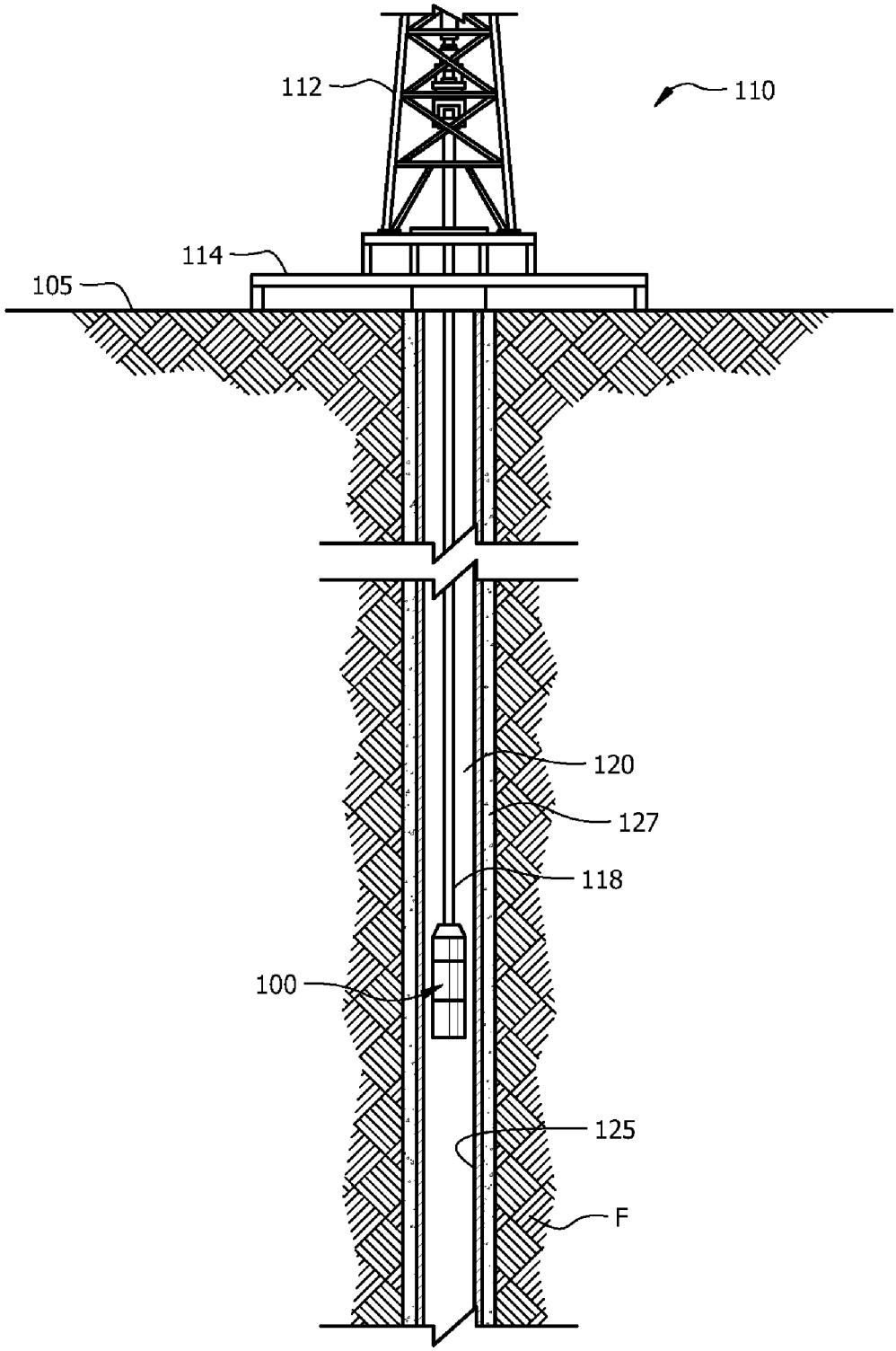
FIG. 1 is a schematic, cross-sectional view of an exemplary operating environment depicting a consumable downhole tool being lowered into a well bore extending into a subterranean hydrocarbon formation.

FIG. 1 schematically depicts an exemplary operating environment for a consumable downhole tool 100. As depicted, a drilling rig 110 is positioned on the earth's surface 105 and extends over and around a well bore 120 that penetrates a subterranean formation F for the purpose of recovering hydrocarbons. At least the upper portion of the well bore 120 may be lined with casing 125 that is cemented 127 into position against the formation F in a conventional manner. The drilling rig 110 includes a derrick 112 with a rig floor 114 through which a work string 118, such as a cable, wireline, E-line, Z-line, jointed pipe, or coiled tubing, for example, extends downwardly from the drilling rig 110 into the well bore 120. The work string 118 suspends a representative consumable downhole tool 100, which may comprise a frac plug, a bridge plug, a packer, or another type of well bore zonal isolation device, for example, as it is being lowered to a predetermined depth within the well bore 120 to perform a specific operation. The drilling rig 110 is conventional and therefore includes a motor driven winch and other associated equipment for extending the work string 118 into the well bore 120 to position the consumable downhole tool 100 at the desired depth.

While the exemplary operating environment depicted in FIG. 1 refers to a stationary drilling rig 110 for lowering and setting the consumable downhole tool 100 within a land-based well bore 120, one of ordinary skill in the art will readily appreciate that mobile workover rigs, well servicing units, such as slick lines and e-lines, and the like, could also be used to lower the tool 100 into the well bore 120. It should be understood that the consumable downhole tool 100 may also be used in other operational environments, such as within an offshore well bore.

Figure 2:
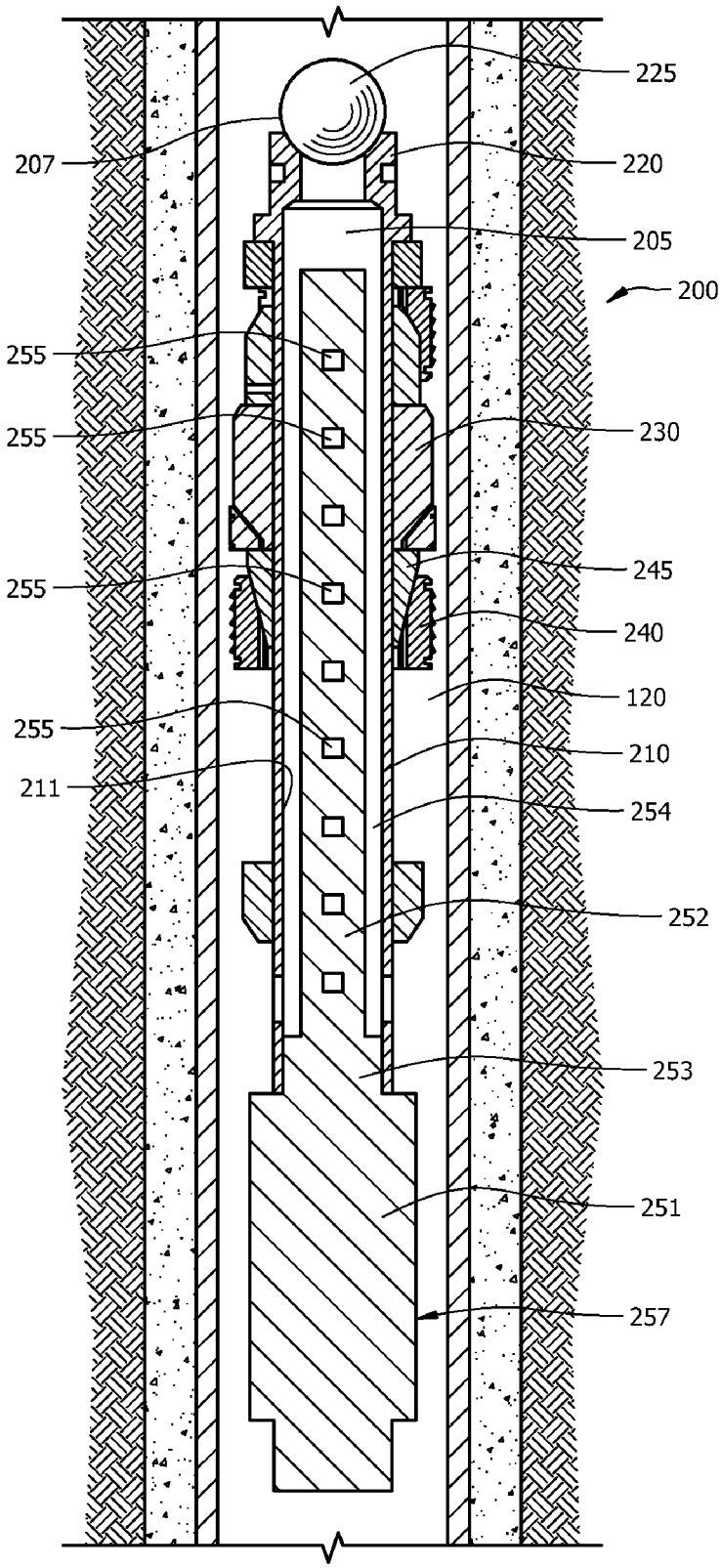
FIG. 2 is an enlarged cross-sectional side view of one embodiment of a consumable downhole tool comprising a frac plug being lowered into a well bore.

The consumable downhole tool 100 may take a variety of different forms. In an embodiment, the tool 100 comprises a plug that is used in a well stimulation/fracturing operation, commonly known as a "frac plug." FIG. 2 depicts an exemplary consumable frac plug, generally designated as 200, as it is being lowered into a well bore 120 on a work string 118 (not shown). The frac plug 200 comprises an elongated tubular body member 210 with an axial flowbore 205 extending therethrough. A ball 225 acts as a one-way check valve. The ball 225, when seated on an upper surface 207 of the flowbore 205, acts to seal off the flowbore 205 and prevent flow downwardly therethrough, but permits flow upwardly through the flowbore 205. In some embodiments, an optional cage, although not included in FIG. 2, may be formed at the upper end of the tubular body member 210 to retain ball 225. A packer element assembly 230 extends around the tubular body member 210. One or more slips 240 are mounted around the body member 210, above and below the packer assembly 230. The slips 240 are guided by mechanical slip bodies 245. A cylindrical torch 257 is shown inserted into the axial flowbore 205 at the lower end of the body member 210 in the frac plug 200. The torch 257 comprises a fuel load 251, a firing mechanism 253, and a torch body 252 with a plurality of nozzles 255 distributed along the length of the torch body 252. The nozzles 255 are angled to direct flow exiting the nozzles 255 towards the inner surface 211 of the tubular body member 210. The firing mechanism 253 is attached near the base of the torch body 252. An annulus 254 is provided between the torch body 252 and the inner surface 211 of the tubular body member 210, and the annulus 254 is enclosed by the ball 225 above and by the fuel load 251 below.

At least some of the components comprising the frac plug 200 may be formed from consumable materials, such as metals, for example, that burn away and/or lose structural integrity when exposed to heat and an oxygen source. Such consumable components may be formed of any consumable material that is suitable for service in a downhole environment and that provides adequate strength to enable proper operation of the frac plug 200. By way of example only, one such material is magnesium metal. In operation, these components may be exposed to heat and oxygen via flow exiting the nozzles 255 of the torch body 252. As such, consumable components nearest these nozzles 255 will burn first, and then the burning extends outwardly to other consumable components.

Any number or combination of frac plug 200 components may be made of consumable materials. In an embodiment, the load bearing components of the frac plug 200, including the tubular body member 210, the slips 240, the mechanical slip bodies 245, or a combination thereof, may comprise consumable material, such as magnesium metal. These load bearing components 210, 240, 245 hold the frac plug 200 in place during well stimulation/fracturing operations. If these components 210, 240, 245 are burned and/or consumed due to exposure to heat and oxygen, they will lose structural integrity and crumble under the weight of the remaining plug 200 components, or when subjected to other well bore forces, thereby causing the frac plug 200 to fall away into the well bore 120. In another embodiment, only the tubular body member 210 is made of consumable material, and consumption of that body member 210 sufficiently compromises the structural integrity of the frac plug 200 to cause it to fall away into the well bore 120 when the frac plug 200 is exposed to heat and oxygen.

The fuel load 251 of the torch 257 may be formed from materials that, when ignited and burned, produce heat and an oxygen source, which in turn may act as the catalysts for initiating burning of the consumable components of the frac plug 200. By way of example only, one material that produces heat and oxygen when burned is thermite, which comprises iron oxide, or rust ($Fe_2O_3$), and aluminum metal power (Al). When ignited and burned, thermite reacts to produce aluminum oxide ($Al_2O_3$) and liquid iron (Fe), which is a molten plasma-like substance. The chemical reaction is:

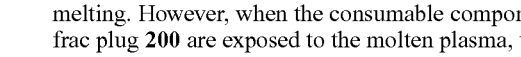

$$Fe_2O_3+2Al(s)\rightarrow Al_2O_3(s)+2Fe(l)$$

The nozzles 255 located along the torch body 252 are constructed of carbon and are therefore capable of withstanding the high temperatures of the molten plasma substance without melting. However, when the consumable components of the frac plug 200 are exposed to the molten plasma, the components formed of magnesium metal will react with the oxygen in the aluminum oxide ($Al_2O_3$), causing the magnesium metal to be consumed or converted into magnesium oxide (MgO), as illustrated by the chemical reaction below:

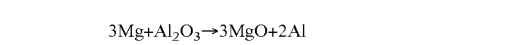

$$3Mg+Al_2O_3\rightarrow 3MgO+2Al$$

When the magnesium metal is converted to magnesium oxide, a slag is produced such that the component no longer has structural integrity and thus cannot carry load. Application of a slight load, such as a pressure fluctuation or pressure pulse, for example, may cause a component made of magnesium oxide slag to crumble. In an embodiment, such loads are applied to the well bore and controlled in such a manner so as to cause structural failure of the frac plug 200.

In one embodiment, the torch 257 may comprise the "Radial Cutting Torch", developed and sold by MCR Oil Tools Corporation. The Radial Cutting Torch includes a fuel load 251 constructed of thermite and classified as a flammable, nonexplosive solid. Using a nonexplosive material like thermite provides several advantages. Numerous federal regulations regarding the safety, handling and transportation of explosives add complexity when conveying explosives to an operational job site. In contrast, thermite is nonexplosive and thus does not fall under these federal constraints. Torches 257 constructed of thermite, including the Radial Cutting Torch, may be transported easily, even by commercial aircraft.

In order to ignite the fuel load 251, a firing mechanism 253 is employed that may be activated in a variety of ways. In one embodiment, a timer, such as an electronic timer, a mechanical timer, or a spring-wound timer, a volume timer, or a measured flow timer, for example, may be used to activate a heating source within the firing mechanism 253. In one embodiment, an electronic timer may activate a heating source when pre-defined conditions, such as time, pressure and/or temperature are met. In another embodiment, the electronic timer may activate the heat source purely as a function of time, such as after several hours or days. In still another embodiment, the electronic timer may activate when predefined temperature and pressure conditions are met, and after a specified time period has elapsed. In an alternate embodiment, the firing mechanism 253 may not employ time at all. Instead, a pressure actuated firing head that is actuated by differential pressure or by a pressure pulse may be used. It is contemplated that other types of devices may also be used. Regardless of the means for activating the firing mechanism 253, once activated, the firing mechanism 253 generates enough heat to ignite the fuel load 251 of the torch 257. In one embodiment, the firing mechanism 253 comprises the "Thermal Generator", developed and sold by MCR Oil Tools Corporation, which utilizes an electronic timer. When the electronic timer senses that pre-defined conditions have been met, such as a specified time has elapsed since setting the timer, one or more AA batteries activate a heating filament capable of generating enough heat to ignite the fuel load 251, causing it to burn. To accelerate consumption of the frac plug 200, a liquid or powder-based accelerant may be provided inside the annulus 254. In various embodiments, the accelerant may be liquid manganese acetate, nitromethane, or a combination thereof.

Figure 3:
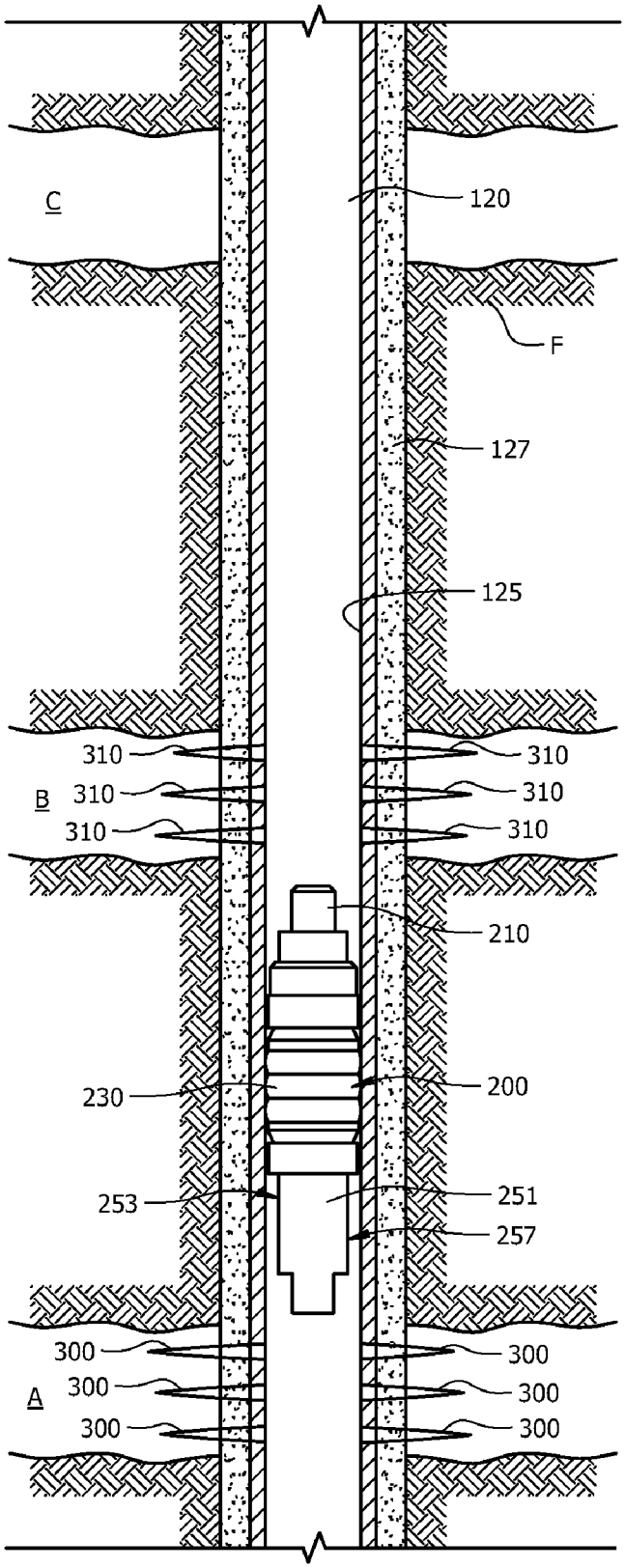
FIG. 3 is an enlarged cross-sectional side view of a well bore with a representative consumable downhole tool with an internal firing mechanism sealed therein.

In operation, the frac plug 200 of FIG. 2 may be used in a well stimulation/fracturing operation to isolate the zone of the formation F below the plug 200. Referring now to FIG. 3, the frac plug 200 of FIG. 2 is shown disposed between producing zone A and producing zone B in the formation F. As depicted, the frac plug 200 comprises a torch 257 with a fuel load 251 and a firing mechanism 253, and at least one consumable material component such as the tubular body member 210. The slips 240 and the mechanical slip bodies 245 may also be made of consumable material, such as magnesium metal. In a conventional well stimulation/fracturing operation, before setting the frac plug 200 to isolate zone A from zone B, a plurality of perforations 300 are made by a perforating tool (not shown) through the casing 125 and cement 127 to extend into producing zone A. Then a well stimulation fluid is introduced into the well bore 120, such as by lowering a tool (not shown) into the well bore 120 for discharging the fluid at a relatively high pressure or by pumping the fluid directly from the surface 105 into the well bore 120. The well stimulation fluid passes through the perforations 300 into producing zone A of the formation F for stimulating the recovery of fluids in the form of oil and gas containing hydrocarbons. These production fluids pass from zone A, through the perforations 300, and up the well bore 120 for recovery at the surface 105.

Prior to running the frac plug 200 downhole, the firing mechanism 253 is set to activate a heating filament when predefined conditions are met. In various embodiments, such predefined conditions may include a predetermined period of time elapsing, a specific temperature, a specific pressure, or any combination thereof. The amount of time set may depend on the length of time required to perform the well stimulation/fracturing operation. For example, if the operation is estimated to be performed in 12 hours, then a timer may be set to activate the heating filament after 12 hours have elapsed. Once the firing mechanism 253 is set, the frac plug 200 is then lowered by the work string 118 to the desired depth within the well bore 120, and the packer element assembly 230 is set against the casing 125 in a conventional manner, thereby isolating zone A as depicted in FIG. 3. Due to the design of the frac plug 200, the ball 225 will unseal the flowbore 205, such as by unseating from the surface 207 of the flowbore 205, for example, to allow fluid from isolated zone A to flow upwardly through the frac plug 200. However, the ball 225 will seal off the flowbore 205, such as by seating against the surface 207 of the flowbore 205, for example, to prevent flow downwardly into the isolated zone A. Accordingly, the production fluids from zone A continue to pass through the perforations 300, into the well bore 120, and upwardly through the flowbore 205 of the frac plug 200, before flowing into the well bore 120 above the frac plug 200 for recovery at the surface 105.

After the frac plug 200 is set into position as shown in FIG. 3, a second set of perforations 310 may then be formed through the casing 125 and cement 127 adjacent intermediate producing zone B of the formation F. Zone B is then treated with well stimulation fluid, causing the recovered fluids from zone B to pass through the perforations 310 into the well bore 120. In this area of the well bore 120 above the frac plug 200, the recovered fluids from zone B will mix with the recovered fluids from zone A before flowing upwardly within the well bore 120 for recovery at the surface 105.

If additional well stimulation/fracturing operations will be performed, such as recovering hydrocarbons from zone C, additional frac plugs 200 may be installed within the well bore 120 to isolate each zone of the formation F. Each frac plug 200 allows fluid to flow upwardly therethrough from the lowermost zone A to the uppermost zone C of the formation F, but pressurized fluid cannot flow downwardly through the frac plug 200.

After the fluid recovery operations are complete, the frac plug 200 must be removed from the well bore 120. In this context, as stated above, at least some of the components of the frac plug 200 are consumable when exposed to heat and an oxygen source, thereby eliminating the need to mill or drill the frac plug 200 from the well bore 120. Thus, by exposing the frac plug 200 to heat and an oxygen source, at least some of its components will be consumed, causing the frac plug 200 to release from the casing 125, and the unconsumed components of the plug 200 to fall to the bottom of the well bore 120.

In order to expose the consumable components of the frac plug 200 to heat and an oxygen source, the fuel load 351 of the torch 257 may be ignited to burn. Ignition of the fuel load 251 occurs when the firing mechanism 253 powers the heating filament. The heating filament, in turn, produces enough heat to ignite the fuel load 251. Once ignited, the fuel load 251 burns, producing high-pressure molten plasma that is emitted from the nozzles 255 and directed at the inner surface 211 of the tubular body member 210. Through contact of the molten plasma with the inner surface 211, the tubular body member 210 is burned and/or consumed. In an embodiment, the body member 210 comprises magnesium metal that is converted to magnesium oxide through contact with the molten plasma. Any other consumable components, such as the slips 240 and the mechanical slip bodies 245, may be consumed in a similar fashion. Once the structural integrity of the frac plug 200 is compromised due to consumption of its load carrying components, the frac plug 200 falls away into the well bore 120, and in some embodiments, the frac plug 200 may further be pumped out of the well bore 120, if desired.

In the method described above, removal of the frac plug 200 was accomplished without surface intervention. However, surface intervention may occur should the frac plug 200 fail to disengage and, under its own weight, fall away into the well bore 120 after exposure to the molten plasma produced by the burning torch 257. In that event, another tool, such as work string 118, may be run downhole to push against the frac plug 200 until it disengages and falls away into the well bore 120. Alternatively, a load may be applied to the frac plug 200 by pumping fluid or by pumping another tool into the well bore 120, thereby dislodging the frac plug 200 and/or aiding the structural failure thereof.

Figure 4:
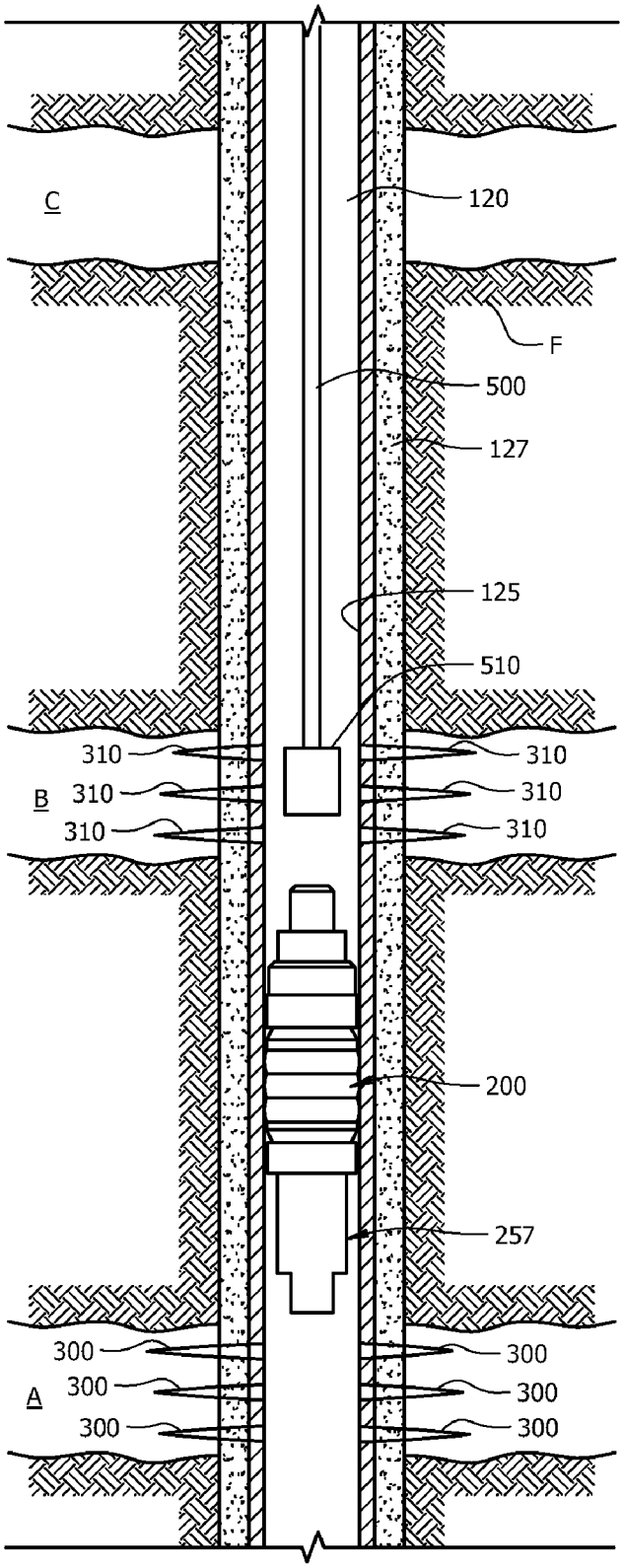
FIG. 4 is an enlarged cross-sectional side view of a well bore with a consumable downhole tool sealed therein, and with a line lowering an alternate firing mechanism towards the tool.

Surface intervention may also occur in the event that the firing mechanism 253 fails to activate the heat source. Referring now to FIG. 4, in that scenario, an alternate firing mechanism 510 may be tripped into the well bore 120. A slick line 500 or other type of work string may be employed to lower the alternate firing mechanism 510 near the frac plug 200. In an embodiment, using its own internal timer, this alternate firing mechanism 510 may activate to ignite the torch 257 contained within the frac plug 200. In another embodiment, the frac plug 200 may include a fuse running from the upper end of the tubular body member 210, for example, down to the fuel load 251, and the alternate firing mechanism 510 may ignite the fuse, which in turn ignites the torch 257.

In still other embodiments, the torch 257 may be unnecessary. As an alternative, a thermite load may be positioned on top of the frac plug 200 and ignited using a firing mechanism 253. Molten plasma produced by the burning thermite may then burn down through the frac plug 200 until the structural integrity of the plug 200 is compromised and the plug 200 falls away downhole.

Removing a consumable downhole tool 100, such as the frac plug 200 described above, from the well bore 120 is expected to be more cost effective and less time consuming than removing conventional downhole tools, which requires making one or more trips into the well bore 120 with a mill or drill to gradually grind or cut the tool away. The foregoing descriptions of specific embodiments of the consumable downhole tool 100, and the systems and methods for removing the consumable downhole tool 100 from the well bore 120 have been presented for purposes of illustration and description and are not intended to be exhaustive or to limit the invention to the precise forms disclosed. Obviously many other modifications and variations are possible. In particular, the type of consumable downhole tool 100, or the particular components that make up the downhole tool 100 could be varied. For example, instead of a frac plug 200, the consumable downhole tool 100 could comprise a bridge plug, which is designed to seal the well bore 120 and isolate the zones above and below the bridge plug, allowing no fluid communication in either direction. Alternatively, the consumable downhole tool 100 could comprise a packer that includes a shiftable valve such that the packer may perform like a bridge plug to isolate two formation zones, or the shiftable valve may be opened to enable fluid communication therethrough.

Figure 5:
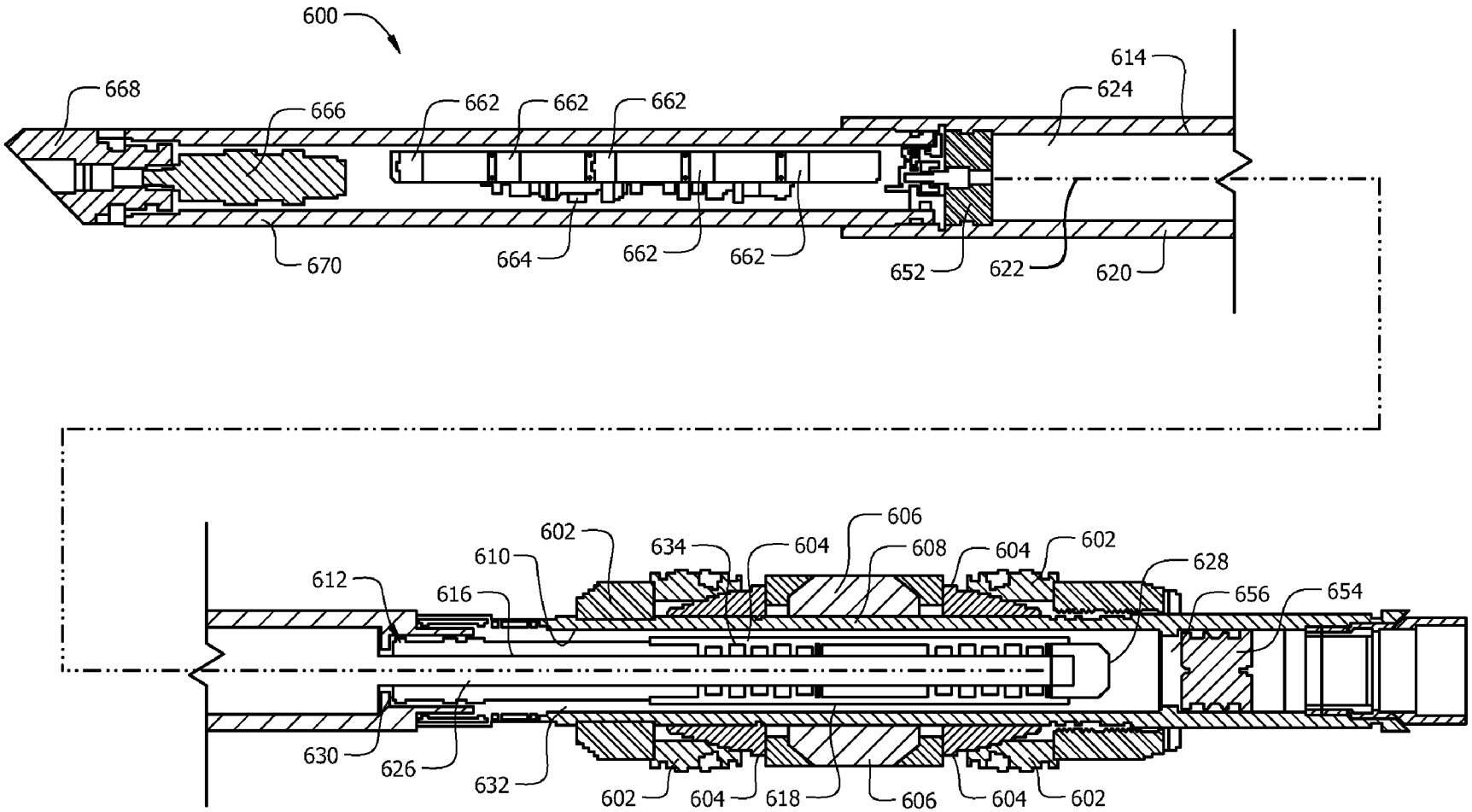
FIG. 5 is an orthogonal cross-sectional view of another embodiment of a consumable downhole tool.

Referring now to FIG. 5, a consumable downhole tool 600 is shown according to another embodiment. The consumable downhole tool 600 is a frac plug comprising slips 602 and slip bodies 604 substantially similar in form and operation to slips 240 and slip bodies 245, respectively. Consumable downhole tool 600 further comprises a packer element assembly 606 substantially similar in form and operation to packer element assembly 230. The slips 602, slip bodies 604, and packer element assembly 606 are located exterior to a body member 608 of the consumable downhole tool 600. In this embodiment, the body member 608 is a tubular member having an inner surface 610. A torch 612 is partially located within an interior of the body member 608 that is bounded by the inner surface 610. The torch 612 generally comprises an upper end 628 located within the interior of the body member 608. The torch 612 extends from the upper end 628 of the torch 612 downward and out of the interior of the body member 608 so that the torch 612 protrudes downward out of the interior of the body member 608. Generally, the torch 612 comprises a fuel load 614, a torch body 616, a sleeve 618, and a main load container 620.

In this embodiment, the torch 612 comprises a central axis 622, about which each of the fuel load 614, the torch body 616, the sleeve 618, and the main load container 620 are substantially aligned and located coaxial. The central axis 622 generally lies parallel to the longitudinal length of the consumable downhole tool 600. The main load container 620 is connected to a lower end of the body member 608 and extends downward. The main load container 620, in this embodiment, is substantially formed as a cylindrical tube well suited for accommodating a primary load portion 624 of the fuel load 614 in a substantially cylindrical volume. A secondary load portion 626 of the fuel load 614 is contiguous with and extends upward from the primary load portion 624 of the fuel load 614. In this embodiment, the secondary load portion 626 is smaller in cross-sectional area than the primary load portion 624. Generally, the secondary load portion 626 extends upward to fill an interior of the torch body 616. In this embodiment, the torch body 616 is substantially a cylindrical tube having a closed upper end 628, an open lower end 630, and a shoulder 632.

Figure 6:
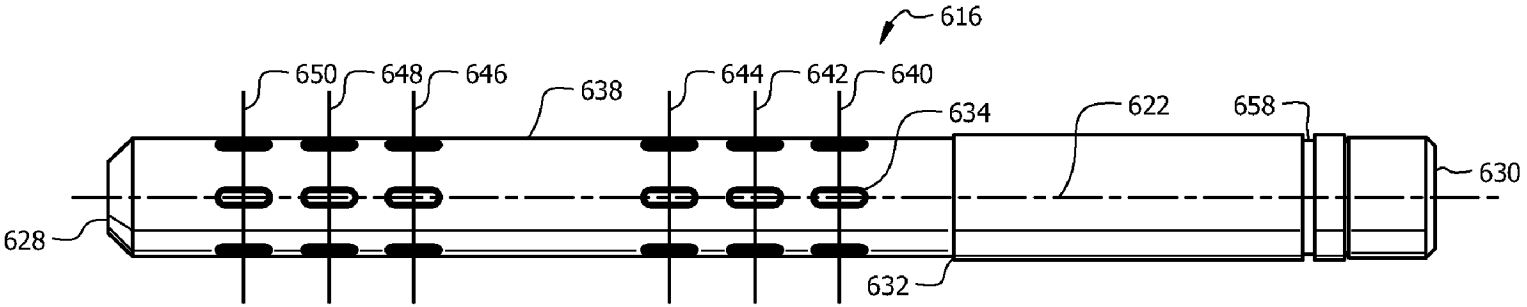
FIG. 6 is an orthogonal view of a torch body of the consumable downhole tool of FIG. 5.
Figure 7:
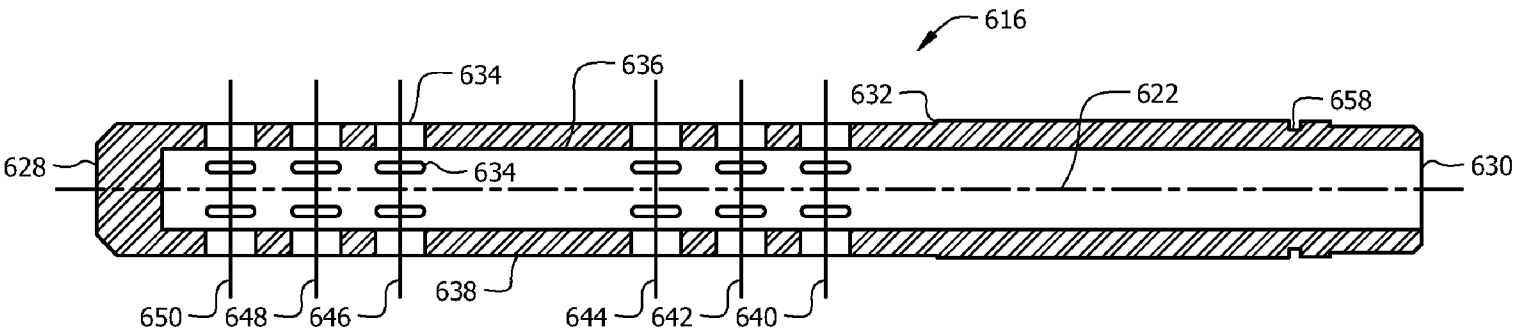
FIG. 7 is an orthogonal cross-sectional view of the torch body of FIG. 6.

Referring now to FIGS. 6 and 7, the torch body 616 is more clearly shown. Particularly, the torch body 616 comprises a plurality of apertures 634 that serve as passages between an interior space of the torch body 616, bounded by an interior wall 636 of the torch body 616, and spaces exterior to the torch body along an outer side wall 638 of the torch body. In this embodiment, the apertures can be described as being distributed along the length of the torch body 616 in radial arrays. Specifically, a first radial array of apertures 634 is disposed at a first orthogonal plane 640 that is substantially orthogonal to the central axis 622. A second radial array of apertures 634 is disposed at a second orthogonal plane 642 (that is also substantially orthogonal to the central axis 622) and the second orthogonal plane 642 is positionally (e.g., upwardly or longitudinally) offset from the first orthogonal plane 640. A third radial array of apertures 634 is disposed at a third orthogonal plane 644 (that is also substantially orthogonal to the central axis 622) and the third orthogonal plane 644 is positionally offset from the second orthogonal plane 642 by a distance substantially equal to the distance between the first orthogonal plane 640 and the second orthogonal plane 642. First, second, and third arrays may form a first array group.

Further, a fourth radial array of apertures 634 is disposed at a fourth orthogonal plane 646 (that is also substantially orthogonal to the central axis 622) and the fourth orthogonal plane 646 is positionally offset from the third orthogonal lane 644 by a distance greater than the distance between the first orthogonal plane 640 and the second orthogonal plane 642. A fifth radial array of apertures 634 is disposed at a fifth orthogonal plane 648 (that is also substantially orthogonal to the central axis 622) and the fifth orthogonal plane 648 is positionally offset from the fourth orthogonal plane 646 by a distance substantially equal to the distance between the first orthogonal plane 640 and the second orthogonal plane 642. Finally, a sixth radial array of apertures 634 is disposed at a sixth orthogonal plane 650 (that is also substantially orthogonal to the central axis 622) and the sixth orthogonal plane 650 is positionally offset from the fifth orthogonal plane 648 by distance substantially equal to the distance between the first orthogonal plane 640 and the second orthogonal plane 642. Fourth, fifth, and sixth arrays may form a second array group, and the first and second array groups may be spaced part as is shown in FIG. 6.

Of course, in other embodiments of a torch body, the distances between the radial arrays and/or groups of radial arrays of apertures 634 may be the same or different. In this embodiment, the apertures 634 are generally elongated slots (e.g., capsule shaped) having rounded ends and rounded transitions between the interior wall 636 and the outer side wall 638. The apertures 634 are generally elongated along the length of the torch body 616, parallel to the central axis 622. In this embodiment, each of the radial arrays of apertures 634 is provided so that six apertures 634 are located, evenly angularly spaced about the central axis 622. In other words, six apertures 634 are provided in each radial array, and adjacent apertures within each radial array are angularly offset by 60°. Also, as shown in FIG. 6, the apertures 634 of each array may be generally aligned along a longitudinal axis, as shown along axis 622. In other embodiments, the apertures of 634 may be offset such that the angular spacing between arrays is different, which may produce a variety of patterns such as helical patterns.

Referring again to FIG. 5, the torch 612 further comprises an igniter 652 substantially similar in form and function to the firing mechanism 253. The igniter 652 is generally located at a bottom end of the primary load portion 624. Unlike the previously described embodiment of the consumable downhole tool of FIG. 2 allowing for fluid flow through the tool, the consumable downhole tool 600 of FIG. 5 is used in conjunction with a bridge plug 654 that is sealingly disposed within the flowbore 656 in which the torch 612 is at least partially disposed. Still further, below the igniter 652, the torch 612 comprises a plurality of batteries 662 operably associated with a circuit board 664 and a pressure switch 666. Together, the batteries 662, circuit board 664, and pressure switch 666 operate to provide selective control over the ignition of igniter 652. A tapered mule shoe 668 serves to hold the pressure switch 666 in place near a lower end of a chamber 670 that is connected to the main load container 620 near a lower end of the main load container 620. In this embodiment, batteries 662, circuit board 664, and pressure switch 666 are also located within an interior of chamber 670.

The sleeve 618 may be constructed of magnesium and is generally a cylindrical tube sized and shaped to cover and seal the apertures 634 from the flowbore 656 to which the apertures 634 would otherwise be in open fluid communication. The sleeve 618 extends from a position in abutment with the shoulder 632 to a position beyond the uppermost portion of the apertures 634 of the sixth radial array of apertures 634. In other words, the sleeve 618 extends, from the shoulder 632, a length sufficient to cover the sixth radial array of apertures 634 located at the sixth orthogonal plane 650. Sealing between the torch body 616 and the sleeve 618 is accomplished by disposing O-rings between the torch body 616 and the sleeve 618. In this embodiment, the torch body 616 comprises at least one circumferential channel 658 to accept and retain an O-ring.

The torch 612 may be required to function properly with at least 4000 psi of hydrostatic pressure. Depending on the circumstances, the torch 612 may even be required to operate at 20,000 psi or higher levels of hydrostatic pressure. Further, it is important to note that while the provision of apertures 634 as described above is described with specificity, many factors must be considered when selecting the particular geometric size, shape, and relative spatial placement of the apertures 634 on the torch body 616. Particularly, the consumable downhole tool 600 is an example of a consumable downhole tool maximized for causing a full to near full, selectively initiated consumption of the tool itself, rather than localized deformation, puncturing, or low order fragmentation of the tool. Some of the factors important to determining aperture 634 size, shape, and layout include, inter alia, the material from which the torch body 616 is constructed, the diameter and wall thickness of the torch body 616, the effective power and force of the fuel load 614, the amount of web space (or contiguous torch body 616 wall structure) necessary to prevent fragmentation of the torch body 616 upon ignition of the fuel load 614, the hydrostatic pressure under which the torch 612 is to operate, and the size and material of the sleeve 618. While the torch body 616 of the consumable downhole tool 600 is constructed of cast iron, using a stronger material such as steel may allow for larger apertures sizes, less web space, and less distance between adjacent apertures. Further, while the sleeve 618 is constructed of magnesium, if the sleeve were constructed of aluminum, the aperture size and layout and the fuel load may need to be adjusted. Considering the many factors that affect performance of the torch 612, it is reasonable for computer aided finite element analysis techniques to be implemented to maximize the performance of the torch 612.

Figure 8:
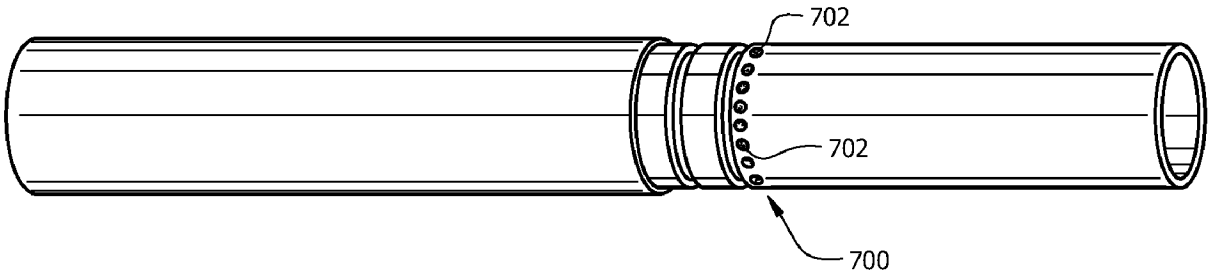
FIG. 8 is a photograph of a torch body according to another embodiment of a consumable downhole tool.
Figure 9:
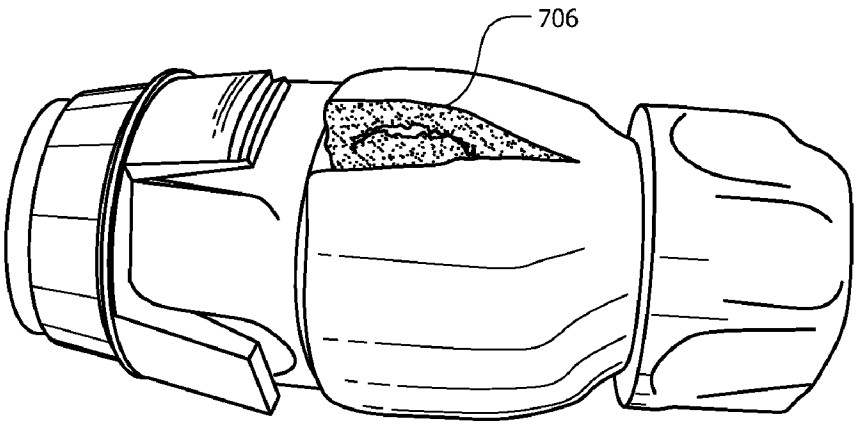
FIG. 9 is a photograph of a component of a structure that was locally deformed when testing the torch body of FIG. 8.
Figure 10:
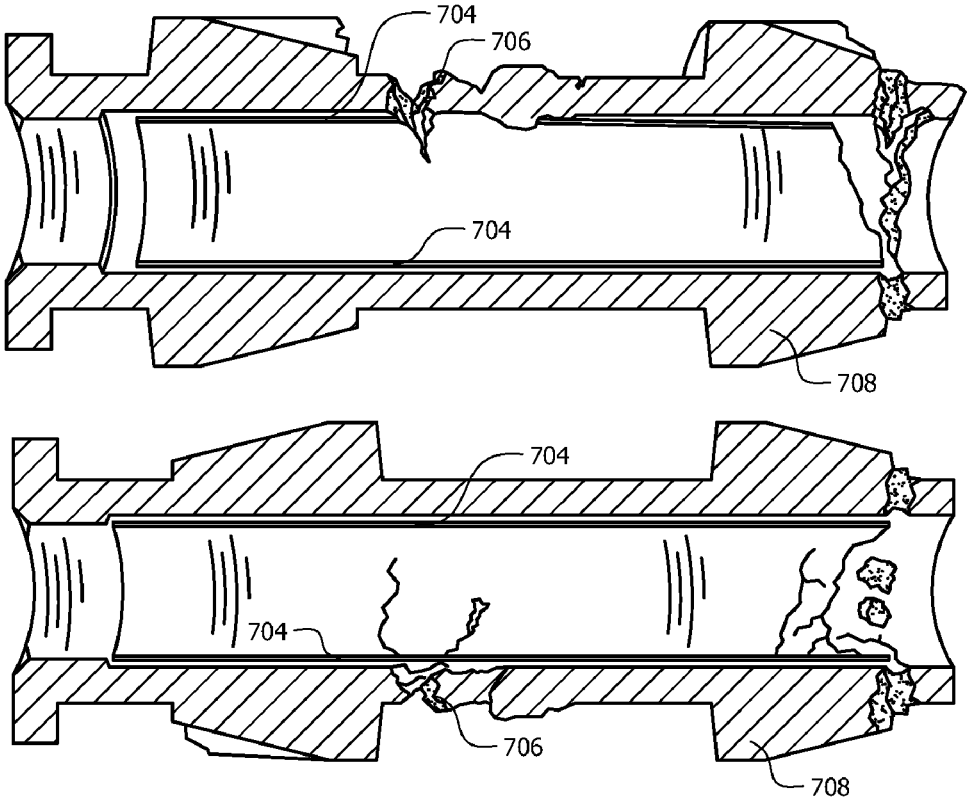
FIG. 10 is a photograph of a cross-sectional tool body that was locally deformed when testing the convention torch body of FIG. 8.
Figure 11:
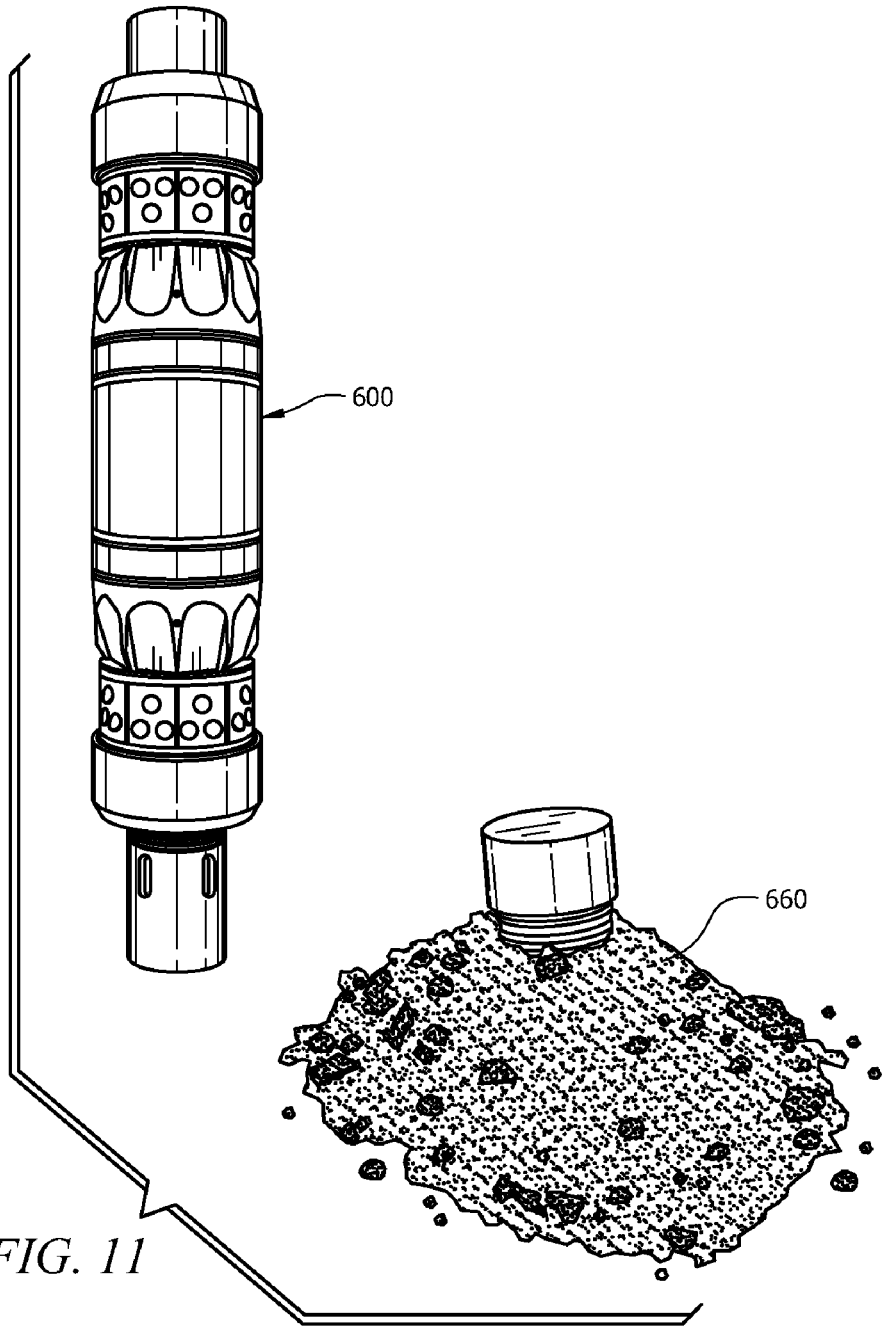
FIG. 11 is a photograph of a consumable downhole tool such as that shown in FIG. 5 prior to testing the torch and after testing the torch.

It is also important to note the significant differences in performance obtained by using the above-described torch 612. Referring now to FIG. 8, a photograph shows a torch body 700, according to another embodiment, having a single radial array of apertures 702 disposed along a single plane orthogonal to a central axis of the generally cylindrical torch body 700. When the torch body 700 was tested in conjunction with an aluminum sleeve (shown as 704 in FIG. 10) analogous to sleeve 618, the results were unsatisfactory. Specifically, FIGS. 9 and 10 show only localized deformation 706 and/or consumption of the associated tool. Particularly, FIG. 10 shows that the aluminum sleeve 704 was hardly consumed and that the tool body 708 remained nearly fully intact. In comparison, it is apparent by viewing FIG. 11 that using the torch 612 having torch body 616 and a magnesium sleeve 618 resulted in near full consumption of the entire consumable downhole tool 600, leaving almost nothing but magnesium oxide ashes 660. This dramatic difference in results is at least partially due to the increased success in causing the magnesium portions of the consumable downhole tool 600 to begin to oxidize at a sustained rate through completion (a process that may take on the order of twenty minutes), rather than a mere explosion or burst of high intensity consumption that does not include a sustained oxidization period for a substantial period after the fuel load has been ignited. The comparative results observed from changing the aperture design and layout (from that shown in FIG. 8 to the apertures 634 of the consumable downhole tool 600) and using a magnesium sleeve 618 (rather than an aluminum sleeve) were particularly surprising and unexpected. Without intending to be limited by theory, the aperture design and layout shown in FIG. 6 may aid in the distribution and application of plasma to a large portion of the consumable tool body and may help avoid plugging of nozzles as shown in FIG. 8.

In operation, the consumable downhole tool 600 is placed within a well bore such as well bore 120 and is used to selectively obstruct fluid flow in the well bore, as previously described with respect to frac plug 200. When the consumable downhole tool 600 is no longer needed, the torch 612 is selectively activated by activating the igniter 652. The igniter 652 starts the conversion of the fuel load 614 into plasma. As the fuel load 614 is converted into plasma, an increase in pressure within the cavities that contained the fuel load 614 causes the plasma to extrude and/or otherwise pass through the apertures 634 and contact sleeve 618. Upon contacting sleeve 618, the plasma burns through and/or causes the sustained consumption of the sleeve 618. Once the plasma has breeched the sleeve 618, the plasma contacts the inner surface 610 of the body member 608 of the consumable downhole tool 600. Without intending to be limited by theory, the ignition and/or consumption of a magnesium sleeve 618 may serve as "kindling" or "tender" to aid ignition and/or consumption of the entire consumable downhole tool 600. The contact between the plasma and the inner surface 610 is such that the inner surface is heated to a degree and over such a period of time that the body member 608, comprising consumable materials such as magnesium, begins to be consumed. More particularly, the body member 608 is caused to burn or oxidize in response to the exposure to the plasma. Since the plasma is placed along a substantial length of the inner surface 610, the body member 608 is substantially evenly heated and readily begins to oxidize at a self-sustaining rate.

Further, when any portion of the oxidizing body member 608, sleeve 618, or other magnesium comprising component of consumable downhole tool 600 is exposed to water during the oxidization process, the oxidization occurs at an accelerated rate. Particularly, if the consumable downhole tool 600 is submerged or otherwise in contact with water in situ within the well bore, the oxidization process will occur faster and with a higher likelihood of near complete consumption. Of course, where there is no naturally occurring water in situ within the formation and well bore to contact the magnesium components of the consumable downhole tool 600, water may alternatively be provided by pumping an aqueous solution into the well bore. The aqueous solution may be any suitable aqueous well bore servicing fluid. Further, it will be appreciated that water may be successfully provided, in whatever form, as an accelerant to the consumption of the consumable downhole tool so long as the water is available for separation into its component elements, oxygen and hydrogen. Generally, it is the separation of the oxygen from the hydrogen that allows the oxidization process of the consumable downhole tool 600 to use the oxygen (formerly bound with the hydrogen) as an accelerant. Thus, in some embodiments, water is a primary or supplemental source of oxygen for oxidation of the downhole tool.

Figure 12:
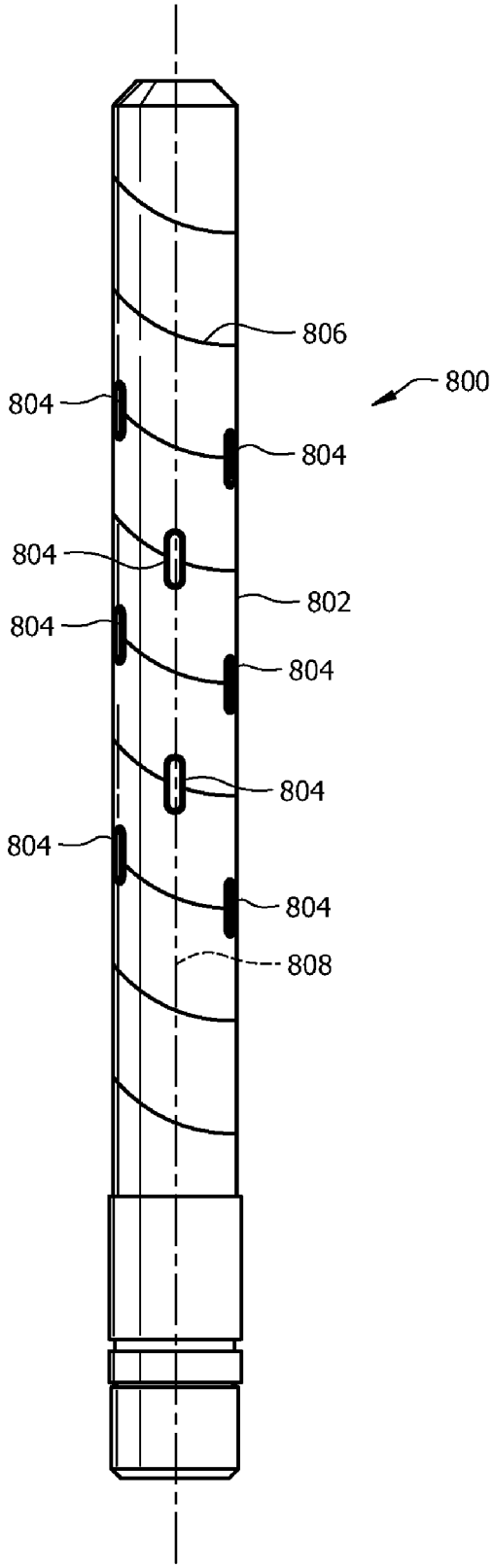
FIG. 12 is an orthogonal view of a torch body according to another embodiment of a consumable downhole tool.

Referring to FIG. 12, another embodiment of a consumable downhole tool 800 comprising a torch body 802 is shown. Torch body 802 is substantially similar to torch body 616 except that the layout of apertures 804 is significantly different. Specifically, the apertures 804 are not disposed in radial arrays in the manner of apertures 634, but rather, apertures 804 are disposed along a helical curve 806 that is coaxial with the central axis 808 of the torch body 802. Placement of the apertures 804 along the helical curve 806, in this embodiment, is such that adjacent apertures 804 on the helical curve are substantially evenly spaced.

Figure 13:
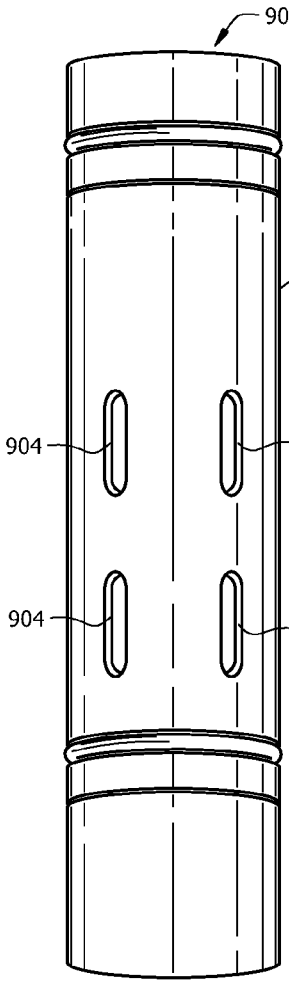
FIG. 13 is an orthogonal view of a torch body according to another embodiment of a consumable downhole tool.

Referring to FIG. 13, another embodiment of a consumable downhole tool 900 comprising a torch body 902 is shown. Torch body 902 is substantially similar to torch body 616 except that the layout of apertures 904 is significantly different. Specifically, torch body 902 comprises only two radial arrays of apertures 904. Another difference between torch body 902 and torch body 616 is that the apertures 904 are longer along the length of torch body 902 than the length of apertures 634 along the length of torch body 616.

Figure 14:
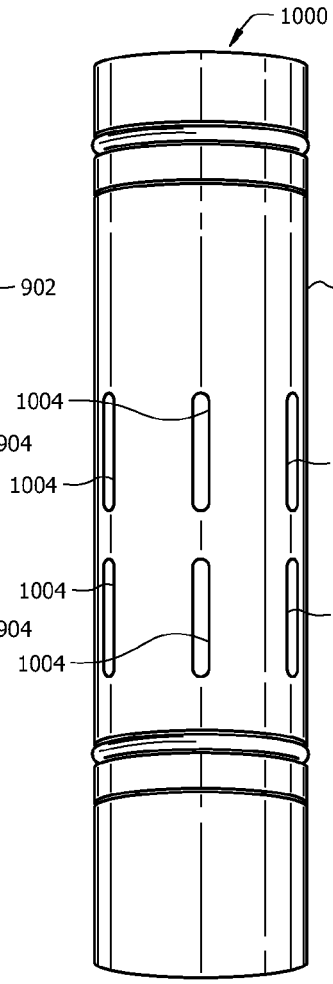
FIG. 14 is an orthogonal view of a torch body according to another embodiment of a consumable downhole tool.

Referring to FIG. 14, another embodiment of a consumable downhole tool 1000 comprising a torch body 1002 is shown. Torch body 1002 is substantially similar to torch body 902 except that the layout of apertures 1004 are elongated slightly more than the apertures 904 and the apertures 1004 are slightly thinner (widthwise about the circumference of the torch body 1002) than the apertures 904.

Figure 15:
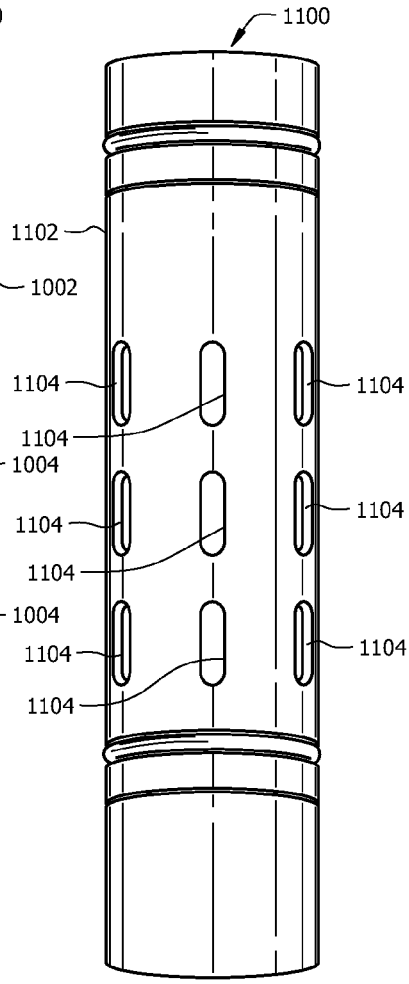
FIG. 15 is an orthogonal view of a torch body according to another embodiment of a consumable downhole tool.

Referring to FIG. 15, another embodiment of a consumable downhole tool 1100 comprising a torch body 1102 is shown. Torch body 1102 is similar to torch body 902 except that there are three rather than only two radial arrays of apertures 1104. In this embodiment, the adjacent radial arrays of apertures 1104 are equally spaced from each other. Further, the apertures 1104 are slightly shorter along the length of the torch body 1102 than the length of the apertures 904 along the length of the torch body 902.

Figure 16:
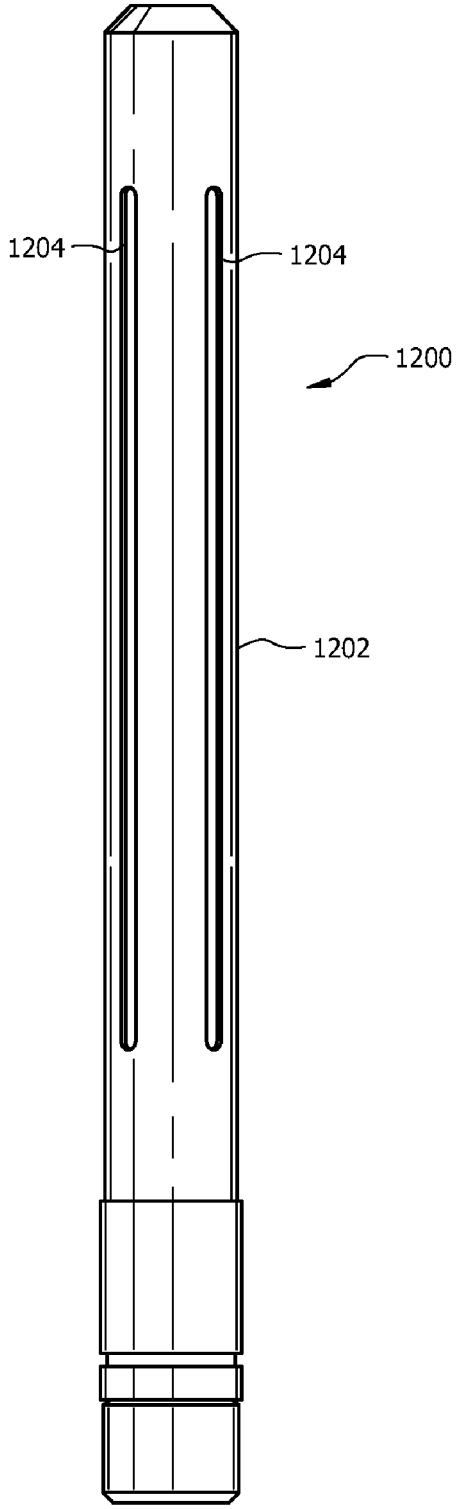
FIG. 16 is an orthogonal view of a torch body according to another embodiment of a consumable downhole tool.

Referring to FIG. 16, another embodiment of a consumable downhole tool 1200 comprising a torch body 1202 is shown. Torch body 1202 is similar to torch body 902 except that there is only one radial array of apertures 1204. Also different from the torch body 902, in this embodiment, the apertures 1204 are much longer along the length of the torch body 1202 than the length of the apertures 904 along the length of the torch body 902. In fact, the apertures 1204, in this embodiment, extend more than half the total length of the torch body 1202.

It will be appreciated that the various embodiments of torches disclosed herein may be associated with any suitable consumable downhole tool, not just a frac plug. Specifically, torch bodies such as torch bodies 616, 700, 802, 902, 1002, 1102, and 1202 may be associated with any consumable downhole tool even though one or more of the torch bodies 616, 700, 802, 902, 1002, 1102, and 1202 is explained above as being associated with a frac plug. Further, it will be appreciated that the various embodiments of torches described above may be used in a consumable downhole tool where a frac ball, such as ball 225, is replaced by a frac plug that seals off a flowbore of the associated consumable downhole tool. Still further, it will be appreciated that while the torch embodiments described above are described as including a sleeve, such as sleeve 618, alternative embodiments of torches may not include such a sleeve. Particularly, where a torch is disposed in a sealed bore in a mandrel, there is no need for such a sleeve.

While various embodiments of the invention have been shown and described herein, modifications may be made by one skilled in the art without departing from the spirit and the teachings of the invention. The embodiments described here are exemplary only, and are not intended to be limiting. Many variations, combinations, and modifications of the invention disclosed herein are possible and are within the scope of the invention. Accordingly, the scope of protection is not limited by the description set out above, but is defined by the claims which follow, that scope including all equivalents of the subject matter of the claims.

The invention claimed is:

1. A method for removing a downhole tool from a wellbore comprising:

(a) placing the downhole tool into the wellbore, wherein the downhole tool comprises a tubular body having a sealing element extending around the tubular body, (b) isolating a portion of the wellbore by engaging the sealing element to a wellbore wall, wherein the sealing element substantially prevents a fluid flow in at least one direction through the wellbore;

(c) igniting a fuel load and exposing at least a portion of the tubular body to heat and water at least until the tubular body begins to oxidize at a self-sustaining rate using oxygen removed from the water, wherein the tubular body continues to oxidize at least until the downhole tool fails structurally; and (d) allowing downhole tool to disengage the wellbore wall.

2. The method of claim 1, wherein the tubular body continues to oxidize at least until the sealing element disengages from the wellbore wall and terminates the isolating of a portion of the wellbore.

3. The method of claim 2, wherein the downhole tool is a frac plug, a bridge plug, or a packer.

4. The method of claim 2, wherein the fuel load comprises thermite.

5. The method of claim 4, wherein a portion of the tubular body comprises magnesium that is consumed upon ignition of the thermite.

6. The method according to claim 5, further comprising: directing the heat along a substantial length of the tubular body.

7. The method according to claim 5, wherein the magnesium to converted to magnesium oxide.

8. The method according to claim 1, wherein the fuel load comprises thermite.

9. The method according to claim 1, further comprising: separating the fuel load and the water at least until a portion of the fuel load is ignited.

10. The method according to claim 1, further comprising: accelerating the oxidization of the consumable downhole tool using the oxygen removed from the water.

11. The method according to claim 1, further comprising: directing the heat along a substantial length of the tubular body.

12. The method according to claim 1, wherein the water is naturally occurring in situ within the well bore.

13. The method according to claim 1, wherein the water is a component of a well bore servicing fluid.

14. The method according to claim 1, wherein the downhole tool is substantially consumed.

15. The method according to claim 12, wherein the downhole tool is engaged to the wellbore wall, and wherein the structural failure causes the downhole tool to release from the wellbore wall.

* * * * *

UNITED STATES PATENT AND TRADEMARK OFFICE

CERTIFICATE OF CORRECTION

PATENT NO. : 8,256,521 B2
APPLICATION NO. : 12/860471
DATED : September 4, 2012
INVENTOR(S) : Loren C. Swor et al.

It is certified that error appears in the above-identified patent and that said Letters Patent is hereby corrected as shown below:

Column 14, line 16, claim 7, replace "to converted" with --is converted--.

Signed and Sealed this
Twenty-seventh Day of November, 2012

David J. Kappos

David J. Kappos
*Director of the United States Patent and Trademark Office*